US007127196B2

(12) United States Patent
Kami et al.

(10) Patent No.: US 7,127,196 B2
(45) **Date of Patent: *Oct. 24, 2006**

(54) ELECTROPHOTOGRAPHIC PHOTORECEPTOR, METHOD FOR MANUFACTURING THE ELECTROPHOTOGRAPHIC PHOTORECEPTOR AND IMAGE FORMING APPARATUS USING THE ELECTROPHOTOGRAPHIC PHOTORECEPTOR

(75) Inventors: Hidetoshi Kami, Numazu (JP); Tatsuya Niimi, Numazu (JP); Akihiko Matsuyama, Isehara (JP); Eiji Kurimoto, Numazu (JP); Nozomu Tamoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/017,731

(22) Filed: Dec. 22, 2004

(65) Prior Publication Data

US 2005/0106482 A1 May 19, 2005

Related U.S. Application Data

(63) Continuation of application No. 10/135,548, filed on May 1, 2002.

(30) Foreign Application Priority Data

May 1, 2001 (JP) ..... 2001-134551

(51) Int. Cl.
*G03G 15/00* (2006.01)

(52) U.S. Cl. ..... 399/159

(58) Field of Classification Search ..... 399/159, 399/111; 430/57.2, 56, 66, 58.05
See application file for complete search history.

(56) References Cited

U.S. PATENT DOCUMENTS

| | | | | |
|---|---|---|---|---|
| 4,540,268 | A * | 9/1985 | Toyono et al. | 399/111 |
| 4,599,286 | A | 7/1986 | Limburg et al. | |
| 5,008,167 | A | 4/1991 | Yu | |
| 5,008,706 | A | 4/1991 | Ohmori et al. | |
| 5,096,795 | A | 3/1992 | Yu | |
| 5,363,176 | A | 11/1994 | Ishihara et al. | |
| 5,679,488 | A | 10/1997 | Itami et al. | |
| 6,030,733 | A | 2/2000 | Kami et al. | |
| 6,573,016 | B1 | 6/2003 | Kami et al. | |
| 2003/0077531 | A1 | 4/2003 | Suzuki et al. | |

FOREIGN PATENT DOCUMENTS

| | | |
|---|---|---|
| DE | 195 40 607 | 5/1996 |
| JP | 46-782 | 9/1971 |
| JP | 52-2531 | 1/1977 |
| JP | 54-44526 | 4/1979 |
| JP | 57-30846 | 2/1982 |
| JP | 57-122444 | 7/1982 |
| JP | 58-121044 | 7/1983 |
| JP | 59-223443 | 12/1984 |
| JP | 59-5223445 | 12/1984 |
| JP | 60-57346 | 4/1985 |
| JP | 61-156052 | 7/1986 |
| JP | 61-251860 | 11/1986 |
| JP | 1-205171 | 8/1989 |
| JP | 03240076 A | 10/1991 |
| JP | 5-40358 | 2/1993 |
| JP | 5-53357 | 3/1993 |
| JP | 5-265241 | 10/1993 |
| JP | 7-261417 | 10/1995 |
| JP | 7-325409 | 12/1995 |
| JP | 8-95278 | 4/1996 |
| JP | 8-272126 | 10/1996 |
| JP | 8-292585 | 11/1996 |
| JP | 8-328286 | 12/1996 |
| JP | 9-12637 | 1/1997 |
| JP | 9-160264 | 6/1997 |
| JP | 9-235442 | 9/1997 |
| JP | 10-20534 | 1/1998 |
| JP | 10-186687 | 7/1998 |
| JP | 10-186688 | 7/1998 |
| JP | 10-239870 | 9/1998 |
| JP | 10-239871 | 9/1998 |
| JP | 10-246978 | 9/1998 |
| JP | 10-288846 | 10/1998 |
| JP | 2000231211 A | 8/2000 |

OTHER PUBLICATIONS

Borsenberger, Paul M. et al. Organic Photorerceptors for Imaging Systems. New York: Marcel-Dekker, Inc. (1993) pp. 6-17.*

* cited by examiner

*Primary Examiner*—Christopher Rodee
(74) *Attorney, Agent, or Firm*—Oblon, Spivak, McClelland, Maier & Neustadt, P.C.

(57) ABSTRACT

An image forming apparatus and a process cartridge having a photoreceptor including an electroconductive substrate; and a photosensitive layer located overlying the electroconductive substrate and comprising a charge generation material, a charge transport material and an inorganic filler, wherein the content of the inorganic filler at a surface side of the photosensitive layer is greater than that at a bottom side of the photosensitive layer near the electroconductive substrate, and wherein an outermost layer of the photoreceptor has a water vapor permeability not greater than 50 $g \cdot m^{-2} \cdot 24\ h^{-1}$.

12 Claims, 6 Drawing Sheets

ELECTROPHOTOGRAPHIC PHOTORECEPTOR, METHOD FOR MANUFACTURING THE ELECTROPHOTOGRAPHIC PHOTORECEPTOR AND IMAGE FORMING APPARATUS USING THE ELECTROPHOTOGRAPHIC PHOTORECEPTOR

CROSS-REFERENCE TO RELATED APPLICATIONS

This application is a Continuation of U.S. patent application Ser. No. 10/135,548, filed May 1, 2002, and claims priority to Japanese Patent Application No. 2001-134551, filed May 1, 2001. The contents of these applications are incorporated herein by reference in their entirety.

BACKGROUND OF THE INVENTION

1. Field of the Invention

The present invention relates to an electrophotographic photoreceptor for use in image forming apparatus such as copiers, facsimiles, laser printers and direct digital platemakers. In addition, the present invention relates to a method for manufacturing the electrophotographic photoreceptor and an image forming apparatus using the electrophotographic photoreceptor.

2. Discussion of the Background

Electrophotographic image forming methods are widely used for copiers, facsimile machines, laser printers, direct digital printing platemakers, etc. Such electrophotographic image forming methods typically include the following processes:

(1) charging a photoreceptor (charging process);
(2) irradiating the photoreceptor with imagewise light to form an electrostatic latent image thereon (imagewise light irradiation process);
(3) developing the electrostatic latent image with a developer including a toner to form a toner image on the photoreceptor (developing process);
(4) transferring the toner image onto a receiving material such as paper optionally via an intermediate transfer medium (transfer process);
(5) fixing the toner image on the receiving material, for example, upon application of heat and pressure thereto (fixing process); and
(6) cleaning the surface of the photoreceptor (cleaning process).

The requisites for such photoreceptors are as follows:

1. being able to be charged in a dark place such that the photoreceptors have a proper electric potential;
2. being able to maintain a charge in a dark place (i.e., the charge decay is little in a dark place); and
3. being able to decay the charge upon irradiation of imagewise light thereto.

In addition, recently the photoreceptors are required to have the following properties:

4. having low manufacturing costs;
5. hardly causing pollution; and
6. being able to stably produce good images for a long period of time without causing undesired images.

As the electrophotographic photoreceptor (hereinafter referred to as a photoreceptor) for use in such electrophotographic image forming methods, photoreceptors having a photoconductive layer formed on an electroconductive substrate and including a material such as selenium, selenium alloys or amorphous silicon; and photoreceptors including a photosensitive layer including an inorganic photoconductive material such as zinc oxide and cadmium sulfide which is dispersed in a binder resin, are well known. However, recently organic photoreceptors have been typically used because of having low costs, good designing flexibility and being non-polluting.

Specific examples of the organic photoreceptors include photoreceptors having the following photosensitive layers:

(1) photosensitive layers including a photoconductive resin typified by polyvinylcarbazole (PVK);
(2) photosensitive layers including a charge transfer complex typified by polyvinylcarbazole-2,4,7-trinitrofluorenon (PVK-TNF);
(3) photosensitive layers including a pigment dispersion typified by a phthalocyanine-binder system; and
(4) functionally-separated photosensitive layers using a combination of a charge generation material and a charge transport material.

Among these photoreceptors, the functionally-separated photoreceptors attract attention now.

The mechanism of forming an electrostatic latent image on a functionally-separated photoreceptor is as follows:

(1) when imagewise light irradiates a charged photoreceptor, the imagewise light is absorbed by a charge generation material in a charge generation layer after passing through a transparent charge transport layer located overlying the charge generation layer;
(2) the charge generation material absorbing light generates a charge carrier;
(3) the charge carrier is injected into the charge transport layer and transported through the charge transport layer (or the photosensitive layer) along an electric field generated by the charge formed on the surface of the photoreceptor; and
(4) the charge carrier neutralizes the charge on the surface of the photoreceptor, resulting in formation of an electrostatic latent image.

In the functionally-separated photoreceptors, a combination of a charge transport material having an absorption in an ultraviolet region and a charge generation material having an absorption in a visible region is known. However, the durability of such organic photoreceptors is not necessarily satisfactory.

Recently, copiers, facsimile machines and laser printers tend to be personalized. Such image forming apparatus need to have high durability and stability (i.e., being maintenance-free), to be small in size and to reuse toner collected in a cleaning section. Therefore, various developing devices having a new configuration have been used, namely, image forming processes have widely changed. Therefore, the requisite of durability increases more and more for the photoreceptors.

In order to impart good durability to a photoreceptor, it is essential to establish a technique by which image problems such as production of image defects and decrease of image density can be avoided even when a large number of copies are produced. It is well known that such image problems are caused by flaws and abrasion of the photoreceptor used.

Therefore, in order to prevent such image problems, it is necessary to impart good durability to photoreceptors.

In attempting to improve the abrasion resistance of photoreceptors, the following proposals have been made.

(1) Abrasion Resistance Improving Methods by Increasing Mechanical Strength of Charge Transporting Layer For example, in Japanese Laid-Open Patent Publications Nos. (hereinafter referred toas JOPs) 10-288846 and 10-239870, it is attempted to improve the abrasion resistance of a photoreceptor by using a polyacrylate resin as a binder resin.

In JOPs 9-160264 and 10-239871, it is attempted to improve abrasion resistance of a photoreceptor by using a polycarbonate resin as a binder resin.

In JOPs 10-186688, 10-186687, and 5-040358, it is attempted to improve abrasion resistance of a photoreceptor by using a polyester resin having a terphenyl skeleton, a polyester resin having a triphenyl methane skeleton, or a polyester resin having a fluorene skeleton as a binder resin, respectively.

In addition, JOPs 9-12637 and 9-235442 have disclosed photoreceptors having a charge transport layer including a binder resin including a polymer blend including a styrene elastomer.

However, in the methods mentioned above the photosensitive layers of the proposed photoreceptors have to include a large amount of a low molecular weight charge transport material in view of photosensitivity of the resultant photoreceptors. Low molecular weight charge transport materials typically make the resultant charge transport layers brittle, and thereby the durability of the photosensitive layer rapidly deteriorates as the content of the low molecular weight charge transport material included therein increases. Therefore, problems such that flaws are caused on the surface of a photoreceptor and the surface is seriously abraded occurs due to such low molecular weight charge transport materials present in the charge transport layer thereof. These problems cannot be avoided only by such methods using a specific binder resin in the photosensitive layers.

(2) Abrasion Resistance Improving Method Using Charge Transporting Polymer Material JOP 7-325409 discloses a photoreceptor which uses a charge transporting polymer material instead of low molecular weight charge transport materials. It is supposed that the photoreceptor has relatively good abrasion resistance compared to the photoreceptor mentioned above in item (1) because the content of the resin component in the photoconductive layer can be relatively increased. However, good durability cannot be imparted to the resultant photoreceptor only by a method in which a charge transport polymer material is used instead of a low molecular weight charge transport material. The reason there for is considered to be that the abrasion of photoreceptors is not caused only by the mechanical stress applied thereto. In addition, it is generally hard to refine such charge transport polymer materials. Namely, if impurities cannot be removed from the photoreceptors, the residual potential of the photoreceptors gradually increases.

(3) Abrasion Resistance Improving Methods by Decreasing Friction Coefficient of Charge Transporting Layer For example, JOPs 10-246978 and 10-20534 have disclosed photoreceptors which have a relatively low friction coefficient because of including a siloxane component in their charge transport layers. JOPs 5-265241 and 8-328286 have disclosed photoreceptors which have a relatively low friction coefficient because of including a particulate fluorine-containing resin in their charge transport layers.

In these proposals, it is attempted that the contact pressure applied to the surface of the photoreceptor can be decreased to improve the durability of the photoreceptor by decreasing the friction coefficient of the surface of the photoreceptor. However, lubricants used for decreasing the friction coefficient typically have a poor affinity for binder resins, and thereby almost all the lubricant included in a photosensitive layer tends to migrate from inside of the photosensitive layer to the surface of the photosensitive layer. Therefore, a problem in that the desired low friction coefficient cannot be maintained for a long period of time occurs.

In addition, when a binder resin having a lubricating property is used, the effect of improving abrasion resistance is not satisfactory, or rather such a binder resin deteriorates the abrasion resistance of the resultant photoreceptor because the resultant photoreceptor has a brittle photosensitive layer.

(4) Abrasion Resistance Improving Method by Providing Protective Layer

For example, In JOP 57-30846, 58-121044, 59-223443 and 59-223445, it is attempted to improve the mechanical strength of a photoreceptor is improved by providing a protective layer on the surface thereof, wherein the protective layer includes a metal or a metal oxide having a specific particle diameter and a specific particle diameter distribution.

The mechanical strength of the surface of a photoreceptor can be improved relatively easily by this technique, and therefore it is an effective method for improving the mechanical strength. However, when conventionally proposed protective layers are formed, other problems such as deterioration of resolution of the produced images and photosensitivity of the photoreceptor tend to occur. Therefore, it can be said that this technique is not a practical method of improving of the abrasion resistance.

It is well known that a heater is provided in an image forming apparatus to prevent dew condensation on the surface of a photoreceptor, resulting in prevention of deterioration of resolution of produced images. However, such a technique not only increases manufacturing costs of the image forming apparatus but also increase power consumption thereof. Therefore, it is not useful.

When a photoreceptor drum is used, a problem in that the photoreceptor vibrates when the photoreceptor is driven to be rotated. In addition, there is a case in which a photoreceptor produces a noise when the photoreceptor is charged. In order to prevent such problems, the photoreceptor drum is often padded with a rubber or a metal block. However, when such a heater is provided in the photoreceptor drum, such a pad cannot be included therein. Therefore it is preferable not to provide such a heater in photoreceptors.

(5) Abrasion Resistance Improving Methods by Reinforcing Charge Transporting Layer For example, JOPs 46-782 and 52-2531 have disclosed photoreceptors, which includes a lubricating filler in the surface of the photoreceptors to attempt to improve the lubricating property of the surface, resulting in prolongation of the life of the photoreceptor.

In addition, JOPs 54-44526 and 60-57346 have disclosed photoreceptors, which includes a filler in an insulating layer or a photosensitive layer of the image bearing member (i.e., a photoreceptor) to attempt to improve the mechanical strength of the photoreceptor.

Further, JOPs 1-205171 and 7-261417 have disclosed layered photoreceptors which have an uppermost layer or a charge transport layer including a filler, to improve the hardness or lubricating property of the layer.

Furthermore, JOP 61-251860 discloses a proposal in which a hydrophobic titanium oxide powder is included in a photoreceptor in an amount of from 1 to 30 parts by weight per 100 parts by weight of the charge transport material used therein to improve the mechanical strength of the photoreceptor.

However, these photoreceptors have drawbacks in that the photosensitivity seriously deteriorates and/or residual potential seriously increases, and thereby the photoreceptors do not function as a photoreceptor. Therefore, these methods are not practical.

On the other hand, the following proposals have been made to improve the stability of the image qualities of images produced by photoreceptors:

(6) Image Stability Improving Methods Using Antioxidant

For example, JOPs 57-122444 and 61-156052 have disclosed photoreceptors which include an antioxidant in the photosensitive layers thereof.

(7) Image Stability Improving Methods Using Plasticizer

For example, JOPs 8-272126 and 8-95278 have disclosed photoreceptors which include a plasticizer in the photosensitive layer thereof.

The methods mentioned in (6) and (7) are effective at preventing deterioration of the charge properties of the photoconductive layers in repeated use. When these compounds are used for a charge transport layer which includes a binder resin and a charge transporting material having low molecular weight, the addition amount of these compounds is limited to a small amount because the charge transporting material is included therein at a high concentration. Therefore, these methods are not effective at improving the durability of the photoreceptor.

In addition, such charge transport layer typically has a relatively low glass transition temperature. When these compounds are added in the charge transport layer, the glass transition temperature of the layer further decreases to a temperature which is almost the same as the inside temperature of an image forming apparatus in which the photoreceptor is arranged. Therefore, other problems such as deformation of the photosensitive layer and toner adhesion to the photosensitive layer tend to occur. Therefore, these methods are also not effective at improving the durability of photoreceptors.

As mentioned in JOPs 8-272126 and 8-292585, the life of a photoreceptor depends on both the mechanical durability (i.e., whether the photoreceptor is hardly abraded or scratched) and electrostatic durability (i.e., whether the charge properties of the photoreceptor are hardly deteriorated in repeated use) thereof. Even when a photoreceptor has a good abrasion resistance, the life of the photoreceptor is deteriorated if the photoreceptor has a poor electrostatic durability (i.e., the electrostatic properties of the photoreceptor deteriorate when the photoreceptor is fatigued and/or the environment surrounding the photoreceptor changes), namely, the life of the photoreceptor depends on the electrostatic durability thereof.

Therefore, in order to prolong the life of a photoreceptor, both the mechanical durability and electrostatic durability of the photoreceptor have to be improved at the same time. In the above-mentioned conventional techniques, it is attempted to improve one of the mechanical durability and electrostatic durability. Namely, both the mechanical durability and electrostatic durability cannot be improved at the same time by these techniques.

In addition, there are many cases in which when it is tried to improve one of the mechanical durability and electrostatic durability of a photoreceptor, the other of the durabilities deteriorates (i.e., relationship between the mechanical durability and electrostatic durability is a trade-off relationship).

Thus, it can be said that the conventional techniques mentioned above are useful for improving a specific property, but are not a technique by which the life of the photoreceptor can be prolonged.

Thus, a photoreceptor having a good combination of mechanical durability and electrostatic durability has not yet developed.

Recently, electrophotographic image forming apparatus have good durability. In order to develop an image forming apparatus having a small size and low manufacturing costs, a photoreceptor having good durability is necessary. In addition, a heater which is used for preventing dew condensation on a photoreceptor and a controller using a potential meter should be omitted therefrom. Therefore, a photoreceptor which is hardly influenced by changes of environmental conditions such as temperature and humidity is needed.

Because of these reasons, a need exists for an electrophotographic photoreceptor which has good durability such that the photoreceptor is considered to be a durable part of an electrophotographic image forming apparatus and good resistance to temperature/humidity changes.

SUMMARY OF THE INVENTION

Accordingly, an object of the present invention is to provide an electrophotographic photoreceptor which has good durability such that images having good image qualities can be produced for a long period of time without causing undesired images and good resistance to temperature/humidity changes.

Another object of the present invention is to provide a method for manufacturing the photoreceptor mentioned above.

Yet another object of the present invention is to provide an electrophotographic image forming method and apparatus by which images having good image qualities can be produced for a long period of time without using a heater to prevent dew condensation on the surface of the photoreceptor used.

Briefly these objects and other objects of the present invention as hereinafter will become more readily apparent can be attained by an electrophotographic photoreceptor including at least an electroconductive substrate and a photosensitive layer located overlying the electroconductive substrate and including at least a charge generation material, a charge transport material and an inorganic filler, wherein the inorganic filler is included in the photosensitive layer such that the content of the inorganic filler at a surface side of the photosensitive layer is greater than that at a bottom side (i.e., a side near the electroconductive substrate), and wherein an uppermost layer of the photoreceptor has a steam transmittance not greater than 50 $g \cdot m^{-2} 24\ h^{-1}$.

The photosensitive layer is preferably a mixture type photosensitive layer in which the charge generation material, charge transport material and inorganic filler are included, or a layered photosensitive layer. It is preferable that the mixture type photosensitive layer has a thickness of from 5 to 50 μm.

The mixture type photosensitive layer preferably includes a first mixture type photosensitive layer including no inorganic filler and a filler-reinforced mixture type photosensitive layer including the inorganic filler are overlaid overlying the electroconductive substrate in this order. The first mixture type photosensitive layer includes one or more charge generation compounds and one or more charge transport compounds and the second mixture type photosensitive layer includes one or more charge generation compounds and one or more charge transport compounds, which are the same as or different from those in the first mixture type photosensitive layer, respectively. The content of the inorganic filler in the filler-reinforced mixture type photosensitive layer is preferably from 5 to 50% by weight based on total weight of the filler-reinforced mixture type photosensitive layer. The filler-reinforced mixture type photosensitive layer preferably has a thickness of from 0.5 to 10 μm.

It is preferable that the layered photosensitive layer is a functionally-separated photosensitive layer including a charge generation layer including the charge generation material and a charge transport layer formed on the charge generation layer and including the charge transport material. The charge transport layer preferably has a thickness of from 5 to 50 μm. The charge transport layer preferably includes a charge transport layer including no filler and a filler-reinforced charge transport layer including the inorganic filler and formed on the charge transport layer including no filler.

It is preferable that the charge transport material includes plural charge transport compounds and the difference in ionization potential between the charge transport compound(s) included in the filler-reinforced charge transport layer and the charge transport compound(s) included in the charge transport layer including no filler is not greater than 0.15 eV. At least one of the charge transport layer including no filler and filler-reinforced charge transport layer preferably includes at least two kinds of charge transport materials, wherein the difference in ionization potential between the charge transport materials is not greater than 0.15 eV.

It is preferable that at least one of the charge transport layer including no filler and filler-reinforced charge transport layer and the combination layer of the charge transport layer including no filler and filler-reinforced charge transport layer has a charge mobility not less than $1.2\times10^{-2}$ $cm^2/V\cdot sec$ at an electric field of $4\times10^5$ V/cm, and in addition, the charge mobility has an electric field dependency β not greater than $1.6\times10^{-3}$, wherein β is defined as follows:

$$\beta=\log \mu/E^{1/2} \tag{1}$$

wherein log represents common logarithm; μ represents the charge mobility of the layer; and E represents the electric field.

The content of the inorganic filler in the filler-reinforced charge transport layer is preferably from 5 to 50% by weight based on total weight of the layer. The filler-reinforced charge transport layer preferably has a thickness of from 0.5 μm to 10 μm.

The inorganic filler included in the filler-reinforced mixture type photosensitive layer or filler-reinforced charge transport layer is preferably a filler having a crystal form of hexagonal close-packed structure. The inorganic filler is preferably an α-alumina, which preferably has an average particle diameter not less than 0.1 μm and less than 0.7 μm.

It is preferable that the α-alumina is preferably polyhedral particles which substantially have no crush surface, and satisfies the following relationship:

$$0.5 \leqq D/H \leqq 5.0$$

wherein D represents a maximum particle diameter of the α-alumina in a direction parallel to the hexagonal close-packed lattice plane; and H represents a maximum particle diameter of the α-alumina in a direction vertical to the hexagonal close-packed lattice plane.

In addition, it is preferable that the α-alumina has a particle diameter distribution such that the following relationship is satisfied:

$$Db/Da \leqq 5$$

wherein Da represents a 10% cumulative particle diameter, wherein particles having the 10% cumulative particle diameter or smaller is present in an amount of 10% by weight; Db represents a 90% cumulative particle diameter, wherein particles having the 9.0% cumulative particle diameter or smaller is present in an amount of 90% by weight.

The mixture type photosensitive layer or the charge transport layer preferably includes a compound having a molecular weight less than 10,000 (i.e., a low molecular weight compound).

In another aspect of the present invention, a method for manufacturing an electrophotographic photoreceptor is provided which includes the steps of coating a first photosensitive layer coating liquid including no filler such as a mixture type photosensitive layer coating liquid or a charge transport layer coating liquid overlying an electroconductive substrate to form a first photosensitive layer overlying the electroconductive substrate; and coating a second photosensitive layer coating liquid including an inorganic filler on the first photosensitive layer to form a second photosensitive layer on the first photosensitive layer.

In yet another aspect of the present invention, a process cartridge is provided which includes the photoreceptor mentioned above and at least one of a charger, an image irradiator, an image developer, an image transfer device, a cleaner and a discharger.

In a further aspect of the present invention, an image forming apparatus is provided which includes the photoreceptor, a charger, an image irradiator, an image developer, an image transfer device and a cleaner. The charger is preferably a charging roller which does not preferably contact the surface of the photoreceptor (i.e., a narrow gap is formed between the surface of the charging roller and the surface of the photoreceptor). The charger preferably applies a DC voltage overlapped with an AC voltage to charge the photoreceptor.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
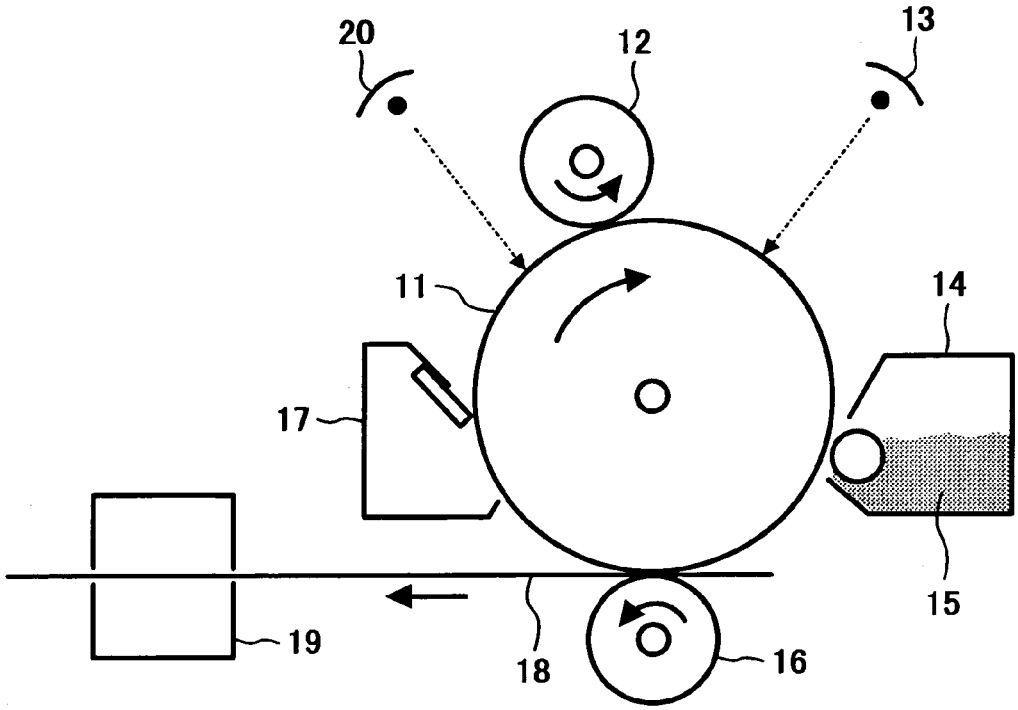
FIG. 1 is a schematic view illustrating an embodiment of the image forming apparatus of the present invention.

The factors affecting the durability (i.e., the life) of a photoreceptor include electrostatic durability which influences the photosensitivity, residual potential and charging ability, and mechanical durability which influences the abrasion and scratch of the surface of the photoreceptor.

The present inventors try to provide a photoreceptor having a good combination of the electrostatic durability and mechanical durability by improving the abrasion resistance by at first studying the factor affecting abrasion and then the measures to prevent the abrasion. Then the present inventors investigate how to improve the electrostatic durability while the mechanical durability is maintained.

As a result of the investigation, it is found that the above-mentioned objects can be attained by a photoreceptor in which at least a photosensitive layer is formed overlying an electroconductive substrate, wherein the content of an inorganic filler at the surface side of the photosensitive layer is greater than that at the bottom side thereof (i.e., at a side near the substrate), and the outermost layer of the photoreceptor has a specific steam transmittance. Thus the present invention is made.

At first the photoreceptor of the present invention will be explained in detail.

The photoreceptor of the present invention has at least an electroconductive substrate and a photosensitive layer formed overlying the electroconductive substrate. The photosensitive layer may be a mixture type photosensitive layer in which both a charge generation material (hereinafter referred to as a CGM) and a charge transport material (hereinafter referred to as a CTM) are dispersed, or a layered photosensitive layer in which a charge generation layer (hereinafter referred to as a CGL) including a CGM and a charge transport layer (hereinafter referred to as a CTL) including a CTM are overlaid in this order. The photosensitive layers will be explained later.

In conventional electrophotographic image forming processes, the abrasion of photoreceptors is caused or accelerated in the following processes.

(1) Abrasion in Cleaning Process

In electrophotographic image forming methods, toner particles remaining on the surface of a photoreceptor are removed by a brush cleaner, a blade cleaner, or the like cleaner. When a cleaning blade is used, a tip edge of the cleaning blade is pressed to the surface of the rotating photoreceptor upon application of pressure to remove the remaining toner particles on the surface of the photoreceptor. In this case, the surface of the photoreceptor is abraded or scratched by being rubbed by the blade. This abrasion is mainly mechanical abrasion.

(2) Abrasion in Charging Process

As mentioned in JOP 10-10767, dielectric breakdown occurs at a defective portion in photoreceptors when the photoreceptors are charged. This phenomenon remarkably occurs in organic photoreceptors which have a low withstand voltage.

In addition, when materials constituting the surface layer of a photoreceptor such as resins tend to degenerate when being repeatedly charged, and thereby the abrasion resistance thereof is deteriorated. Therefore, when such a photoreceptor is repeatedly used, the abrasion amount of the outermost layer increases, resulting in shortening of the life of the photoreceptor.

Further, when charging, electric discharging is strongly performed on a thin portion of a surface layer. Therefore, the abraded portion easily degenerates, and thereby the abraded portion is further abraded, resulting in acceleration of adhesion abrasion (i.e., fatigue abrasion).

(3) Abrasion in Developing Process

In developing methods using a two-component developer including a toner and a carrier, the surface of a photoreceptor is abraded by the carrier, resulting in occurrence of abrasive abrasion. In addition, a hard material such as silica is included in the toner as a fluidizing agent, and such a material serves as an abrasive. Thus, in the developing section the photoreceptor is continuously abraded by small particles such as the carrier and fluidizing agent. Namely, the photoreceptor is abraded as if it is filed away or polished by such an abrasive.

In addition, in developing processes including a one-component developer or a two-component developer, actions in which the toner adheres on the surface of a photoreceptor, and then the toner is transferred onto a receiving material or removed by a cleaner are repeatedly performed. At this point, the adhesion of the toner to the photoreceptor cannot be neglected, and therefore adhesion abrasion is caused when the toner is released from the surface of the photoreceptor.

In contrast, when adhesion of the toner to the photoreceptor is very strong, the toner is accumulated on the surface of the photoreceptor, and thereby a toner film is formed on the surface of the photoreceptor, also resulting in shortening of the life of the photoreceptor.

In order to improve the abrasion resistance of a photoreceptor, at least measures against the abrasion mentioned above in paragraphs (1) to (3) have to be taken.

As a result of the present inventors' investigation on the abrasion mentioned above, it is found that the above-mentioned technique in which an inorganic filler is included in an outermost layer is the most effective therefor. The reason is not clear but is considered to be as follows.

A photoreceptor having a good combination of abrasion resistance and charge properties cannot be provided by merely improving the mechanical strength of the outermost layer, which is represented as a product of a tensile strength and a stress. In addition, when the outermost layer of a photoreceptor is made of only an organic material, the withstand voltage of the photoreceptor is limitedly improved. Further, it is found that abrasion of photoreceptors is mainly caused in a developing process. This is because the hardness of the materials included in developers is typically much greater than that of the materials included in the outermost layer of photoreceptors. Therefore, it is considered that to include an inorganic filler in an outermost layer is effective at solving the problems.

It is also found by the present inventors that abrasion speed of the outermost layer of photoreceptors largely depends on the strength of charging. Namely, the abrasion of photoreceptors caused by mechanical stresses is accelerated by degeneration of the surface of the photoreceptors caused by charging.

By adding an inorganic filler in a photoreceptor, the area of a polymer film of the outermost layer decreases because the inorganic filler particles are projected from the surface of the outermost layer. Therefore the degeneration of the outermost layer caused by charging can be decreased by the percentage of the area of the projected inorganic filler. Therefore the abrasion speed of the outermost layer can be improved.

It is important for improving the abrasion resistance of a photoreceptor to select an inorganic filler and a binder resin such that the inorganic filler has a high hardness and a good affinity for the binder resin (i.e., the filler has good packing property in the binder resin) to prevent abrasion of the filler itself and releasing of the filler from the outermost layer.

As a result of the present inventors' investigation, the present inventors obtain the following knowledge with respect to abrasion resistance.

(1) Among inorganic fillers, α-alumina is very useful for improving the abrasion resistance of an outermost layer of a photoreceptor;

(2) The greater the content of an inorganic filler in an outermost layer, the better the abrasion resistance of the outermost layer. When the content of a filler in an outermost layer is not less than 5% by weight, the resultant photoreceptor has good abrasion resistance;

(3) When the binder resin has a weight average molecular weight not less than $4\times10^4$, the resultant photoreceptor has good abrasion resistance; and (4) The thicker the outermost layer (i.e., the protective layer), the better the abrasion resistance of the photoreceptor.

Various fillers have been proposed for protective layers (i.e., outermost layers). Among these fillers, fillers which are easily ground cannot improve the abrasion resistance of the protective layers. In addition, when a filler having a low light transmittance is used, the resultant protective layer hardly transmits imagewise light to the photosensitive layer, and therefore the protective layer cannot be thickened.

The present inventors discover that α-alumina has a combination of good abrasion resistance and a good translucency. By controlling the content of α-alumina in the protective layer and the thickness of the protective layer, a photoreceptor having a desired abrasion speed can be provided. By controlling the abrasion speed of the outermost layer of a photoreceptor, occurrence of blurred images can be prevented.

When a binder resin included in a protective layer having a weight average molecular weight not less than $4.0\times10^4$, a filler included in the protective layer can be fixed in the binder resin, and thereby the performance of the filler of the protective layer can be fully exerted (i.e., the abrasion resistance can be improved to the extent depending on the property of the filler).

By using the above-mentioned knowledge, excellent abrasion resistance can be imparted to a photoreceptor.

Next, methods for improving electrostatic properties will be explained in detail.

Methods in which the abrasion resistance of a photoreceptor is improved by adding a filler in the outermost layer of the photoreceptor have been proposed. However, the methods have a drawback in that the potential of a lighted portion of the resultant photoreceptor increases, resulting in formation of images having poor contrast.

The present inventors investigate how to improve the electrostatic properties of a photoreceptor including a filler in the outermost layer thereof. As a result thereof, the following knowledge is obtained:

(1) Even when a filler is included in a photosensitive layer, the increase of potential of a lighted portion can be prevented if the layer including the filler includes a CTM or a CGM at a high concentration;

(2) It is better to include a filler only in a protective layer (i.e., an outermost layer) than to uniformly include the filler in the photosensitive layer in view of the increase of potential of a lighted portion;

(3) In photoreceptors including a filler in their outermost layer, by forming a photosensitive layer including a CTM, a CGM and the filler or a CTL including a CTM and the filler on another photosensitive layer including no filler or another CTL including no filler (i.e., by functionally-separating the photosensitive layer or CTL), the layer including the filler can be thickened and the content of the filler can be increased while the potential of a lighted portion is maintained;

(4) The increase of potential of a lighted portion of a photoreceptor including a filler in its outermost layer largely depends on the species of the filler. Among fillers, fillers having a hexagonal close-packed structure are preferable because the increase of potential of a lighted portion can be prevented;

(5) By including an electric resistance decreasing agent (hereinafter referred to as a resistivity decreasing agent) in a layer including a filler, the increase of potential of a lighted portion of the resultant photoreceptor can be prevented;

(6) By subjecting a filler to a hydrophobizing treatment, the potential of a lighted portion of the resultant photoreceptor can be decreased;

(7) By using two or more kinds of CTMs, the potential of a lighted portion of the resultant photoreceptor can be often decreased. In addition, by using two or more kinds of CTMs, two or more requisites such as improvement of gas resistance, mechanical strength and anti-cracking property can be often fulfilled at the same time;

(8) By including two or more kinds of CTMs in a layer including a filler or a CTL including no filler, the increase of potential of a lighted portion of the resultant photoreceptor can be prevented if the difference in ionization potentials of the CTMs is not greater than 0.15 eV (when the difference is too large, the potential of a lighted portion often increases); and (9) When the CTM included in a layer including a filler is different from the CTM included in a CTL, the difference in ionization potentials of the CTMs is preferably not greater than 0.15 eV to decrease the potential of a lighted portion. When the difference is too large, the potential of a lighted portion often increases.

It is possible that a CTM or a CGM is added to an outermost layer (protective layer) in an amount to impart photosensitivity to the layer, thereby decreasing the potential of a lighted portion. In addition, it is also possible to add a resistivity decreasing agent in an outermost layer to prevent trapping of charge carriers. Further, it is also possible to reform the surface of the filler included in the outermost layer to prevent formation of carrier traps in the outermost layer. Thus, good electrostatic properties can be imparted to the resultant photoreceptor.

It is preferable to include a CTM having a high charge mobility in an outermost layer, in particular, a CTM having a high charge mobility even at a low electric field.

In addition, when the CTM included in a CTL is different form the CTM included in an outermost layer, the difference in ionization potential of the CTMs is preferably little. When the ionization potential difference is large, the potential of a lighted portion often increases. The reason is considered to be that the CTMs tend to migrate into the other layer, resulting in formation of charge traps in the layers.

For the same reason, when an outermost layer or a CTL includes two or more kinds of CTMs, the difference in ionization potential of the CTMs is preferably little.

By using the above-mentioned techniques, a photoreceptor having a combination of good mechanical durability and good electrostatic properties can be provided.

Even when a photoreceptor which includes an inorganic filler in a layer and which has good abrasion resistance is provided, there is a case in which images having poor resolution and/or undesired images such as background development are produced when the CTL is exposed to acidic gases. For example, when a charger which generates a large amount of ozone is generated is used for charging the photoreceptor, this phenomenon often occurs. When a photoreceptor is used in a room in which a kerosene stove and/or a volatile cleaning fluid are used, the photoreceptor tends to be contaminated with acidic materials such as NOx, etc., resulting in deterioration of charge properties of the photoreceptor. Therefore, in order to impart good durability, measures against this problem have to be taken.

The present inventors investigate the measures against this problem, which can be used together with the above-mentioned abrasion improving techniques. As a result thereof, the following knowledge can be obtained:

(1) In the photoreceptors having such a configuration as mentioned above, the more the water vapor permeability of the outermost layer of the photoreceptors, the worse the charge properties of the photoreceptors, when the photoreceptors are repeatedly used; and (2) In the photoreceptors having such a configuration as mentioned above, the more the water vapor permeability of the outermost layer of the photoreceptors, the worse the charge properties (such as charge potential and photosensitivity) of the photoreceptors, when the photoreceptors are exposed to reactive gasses.

The reason for this phenomenon is considered to be that discharge-induced materials such as ozone and NOx penetrate into the outermost layer of the photoreceptors, resulting in deterioration of charge properties of the photoreceptors. The reason for the deterioration of photosensitivity is considered to be that the discharge-induced materials penetrating the outermost layer act on the photosensitive layer such as CGL and CTL, resulting in acceleration of the deterioration of charge properties.

In addition, images produced by photoreceptors including an inorganic filler under high humidity conditions are often blurred (i.e., the resolution of the images deteriorates). In order to provide a photoreceptor (or an image forming apparatus) having good durability, this problem has to be prevented.

As mentioned above, by controlling the steam transmittance of the outermost layer of a photoreceptor so as to be not greater than a predetermined value, the electrostatic durability can be improved JOP 8-272126 discloses a photoreceptor which includes an outermost layer having a specific oxygen transmittance and 5-53357 discloses a photoreceptor which includes a protective layer having a specific nitrogen transmittance. It seems that these photoreceptors are similar to the photoreceptor of the present invention.

However, in these background art, the oxygen (or nitrogen) transmitting property of the outermost layer (i.e., the oxygen (or nitrogen) permeability per a layer having a unit thickness (i.e., transmittance)) is specified. In contrast, in the present invention, the water vapor permeability itself of the outermost layer is specified independently of the thickness of the layer. Therefore, the techniques in the background art are different from the present invention in physical meaning. In particular, when a functionally-separated photosensitive layer is used or a thin outermost layer is used, the difference largely influences on the properties of the resultant photoreceptors.

Specifically, when an outermost layer having a low gas transmittance is used, the penetrating degree of the gas penetrating into the outermost layer is low, and thereby the deterioration of the outermost layer itself can be prevented to some extent. However, when such an outermost layer is thinned, the gas tends to filter out the layer, and thereby the photosensitive layer (for example, a mixture type photosensitive layer, and a combination of a CGL with a CTL) located below the outermost layer tends to be damaged, resulting in acceleration of shortening of the life of the photoreceptor.

Recently, copy images produced by electrophotographic processes are required to have high resolution. Therefore, the outermost layer becomes thinner and thinner. A photoreceptor having good durability while fulfilling such a requirement cannot be provided by merely controlling the gas transmittance of the outermost layer of the photoreceptor. It is important to specify the gas permeability of the outermost layer. As a result of the present inventors' investigation on water vapor permeability, the following knowledge (3) is obtained:

(3) The higher the content of the low molecular weight compound in the outermost layer, the lower the water vapor permeability of the layer.

Therefore, by adding a low molecular weight compound in an outermost layer, the water vapor permeability of the layer can be decreased because low molecular weight compounds have a high gas barrier property. It is preferable that the low molecular weight compound added in the outermost layer preferably has a charge generation ability or charge transport ability.

The present inventors investigate the relationship between addition amounts of a low molecular weight compound such as antioxidants, plasticizers, lubricants, ultraviolet absorbents and low molecular weight CTMs in a photosensitive layer and the water vapor permeability of the resultant layer. As a result thereof, the following knowledge (4) is obtained:

(4) In a photoreceptor having a layer including an inorganic filler mentioned above, the water vapor permeability of the outermost layer can be dramatically improved by adding a low molecular weight organic compound such as antioxidants and plasticizers even when the addition amount is small.

The present inventors obtain the following knowledge (5) from the knowledge (4):

(5) In a photoreceptor having a layer including an inorganic filler mentioned above, the water vapor permeability of the outermost layer can also be improved by adding a resin having a high gas barrier property. In addition, it is also found that by using a polymer, which is (co)polymerized using a component having a high gas barrier property, as a binder resin in the outermost layer, the resultant outermost layer has a low water vapor permeability.

Further, the present inventors discover that the water vapor permeability of an outermost layer can also be decreased by the following method:

(6) The water vapor permeability of an outermost layer decreases as the outermost layer thickens. Even when a material having a relatively low gas barrier property is used, the water vapor permeability can be decreased if the outermost layer is thickened so as to have a thickness in a specific range.

In addition, the present inventors investigate relationship between the water vapor permeability of an outermost layer and the background development of the images produced by the resultant photoreceptor. As a result of the investigation, the background development problem does not occur when the water vapor permeability of the outermost layer is not greater than 50 $g \cdot m^{-2} \cdot 24\ h^{-1}$. When the water vapor permeability is greater than 50 $g \cdot m^{-2} \cdot 24\ h^{-1}$, the degree of the background development increases as the water vapor permeability increases in proportion to the water vapor permeability.

In addition, it is also found that by forming an outermost layer having such a specific water vapor permeability as mentioned above, a problem in that resolution of images deteriorates under high humidity conditions can also be prevented. The reason for the deterioration of the resolution of images under high humidity conditions is considered to be decrease of the electric resistance of the photosensitive layer due to absorption of moisture of the photosensitive layer. By forming an outermost layer having such a water vapor permeability as mentioned above, the change of the electric resistance of the photosensitive layer can also be prevented.

Images produced by conventional photoreceptors having a layer including an inorganic filler under high humidity conditions are often blurred (i.e., the images have poor resolution). Therefore, a heater has to be provided in an image forming apparatus using such a photoreceptor to prevent dew condensation on the photoreceptor. In contrast, images produced by the photoreceptor of the present invention have good resolution, and therefore it is not needed to provide a heater in an image forming apparatus using the photoreceptor. Therefore, the image forming apparatus can be minimized in size and power consumption thereof can be decreased.

Since the photoreceptor of the present invention is hardly abraded (i.e., the abrasion is very little) even when repeatedly used for a long period of time, the change in water vapor permeability of the outermost layer is also very little. Therefore, even when the photoreceptor of the present invention is repeatedly used for a long period of time, images having good image qualities can be stably produced.

Since the photoreceptor of the present invention has an outermost layer having a high gas barrier property and good abrasion resistance, the total thickness of the photosensitive layers can be decreased, and thereby high resolution images can be stably produced.

The gas barrier property of the outermost layer can be controlled by one or more of the following methods:

(1) adding a low molecular weight compound such as antioxidants in a portion of or entire the outermost layer;
(2) adding a resin having a high gas barrier property in the outermost layer;
(3) adding a copolymer having a component having a high gas barrier property in the outermost layer; and
(4) thickening the outermost layer; and the like methods.

In the functionally-separated photoreceptor having a filler-reinforced mixture type photosensitive layer or a filler-reinforced CTL, the mixture type photosensitive layer or CTL, which does not include a filler and which is located below the filler-reinforced layer, can be freely designed in view of mechanical strength and releasability (namely, the layer has high designing flexibility) because the upper layer is a functional layer. Therefore it can be said that the photoreceptor of the present invention has good designing flexibility.

The electrophotographic organic photoreceptor of the present invention will be explained in detail referring to drawings.

Figure 4:
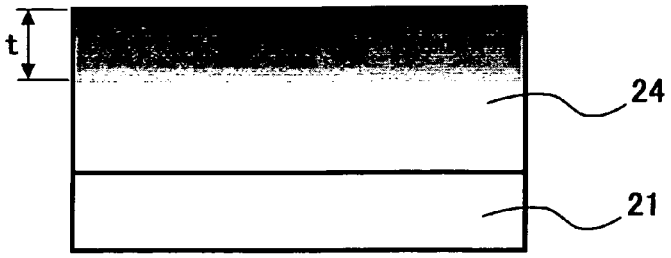
FIGS. 4 to 11 are schematic views illustrating cross sections of embodiments of the electrophotographic photoreceptor of the present invention.

FIG. 4 is a schematic view illustrating the cross section of an embodiment of the photoreceptor of the present invention. The photoreceptor has a mixture type photosensitive layer 24 which is formed on an electroconductive substrate 21. As illustrated in FIG. 4, the filler content at the surface side of the photosensitive layer 24 is greater than that at the bottom side thereof.

Figure 5:
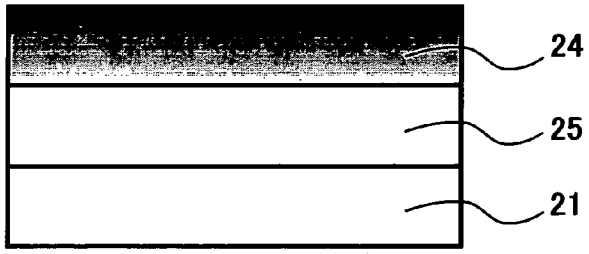

FIG. 5 is a schematic view illustrating the cross section of another embodiment of the photoreceptor of the present invention. As shown in FIG. 5, an undercoat layer 25 is formed between a photosensitive layer 24 and an electroconductive substrate 21. The filler content at the surface of the photosensitive layer 24 is greater than that at the bottom thereof.

Figure 6:
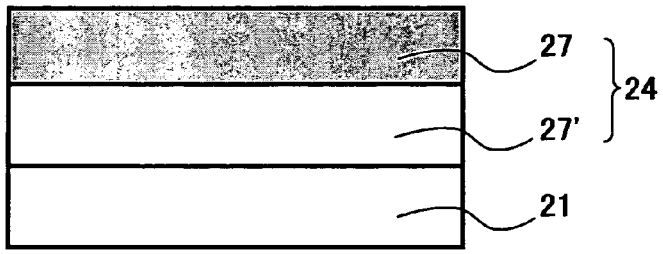

FIG. 6 is a schematic view illustrating the cross section of yet another embodiment of the photoreceptor of the present invention. In the photoreceptor, a mixture type photosensitive layer 24 including a first mixture type photosensitive layer 27' including no filler and a filler-reinforced mixture type photosensitive layer 27 including a filler (hereinafter sometimes referred to as a second photosensitive layer) is formed on an electroconductive substrate 21 in this order.

Figure 7:
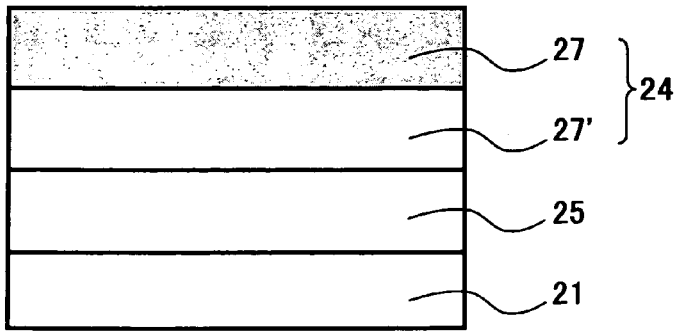

FIG. 7 is a schematic view illustrating the cross section of a further embodiment of the photoreceptor of the present invention. In the photoreceptor, an undercoat layer 25 is formed between an electroconductive substrate 21 and a mixture type photosensitive layer 24 which includes a first mixture type photosensitive layer 27' including no filler and a filler-reinforced mixture type photosensitive layer 27 including a filler.

Figure 8:
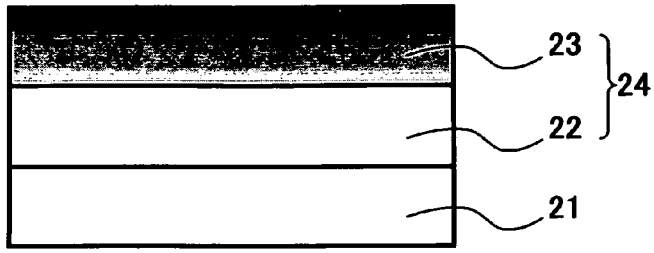

FIG. 8 is a schematic view illustrating the cross section of a still further embodiment of the photoreceptor of the present invention. In the photoreceptor, a layered photosensitive layer including a CGL 22 and a CTL 23 located on the CGL 22 is formed on an electroconductive substrate 21. The filler concentration at the surface side of the CTL 23 is greater than that at the bottom side of the CTL 23.

Figure 9:
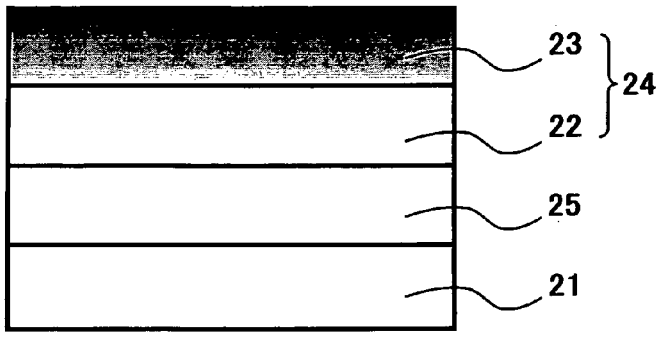

FIG. 9 is a schematic view illustrating the cross section of a still further embodiment of the photoreceptor of the present invention. In the photoreceptor, an undercoat layer 25 is formed between an electroconductive substrate 21 and a layered photosensitive layer 24 including a CGL 22 and a CTL 23. The filler concentration at the surface side of the CTL 23 is greater than that at the bottom side of the CTL 23.

Figure 10:
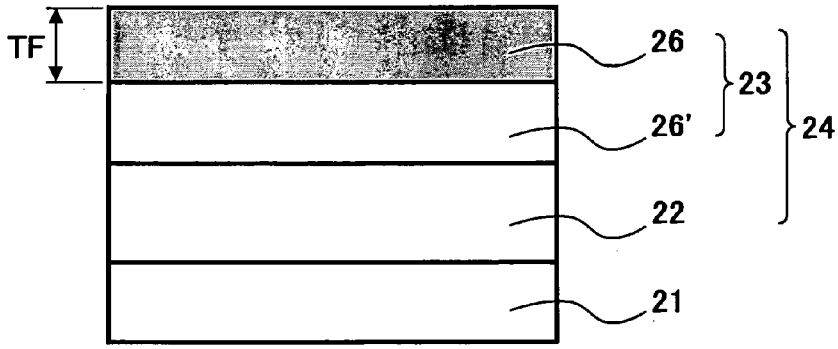

FIG. 10 is a schematic view illustrating the cross section of a still further embodiment of the photoreceptor of the present invention. In the photoreceptor, a CTL 23 including a first CTL 26' including no inorganic filler and a filler-reinforced CTL 26 (hereinafter sometimes referred to as a second CTL) are overlaid on a CGL 22.

Figure 11:
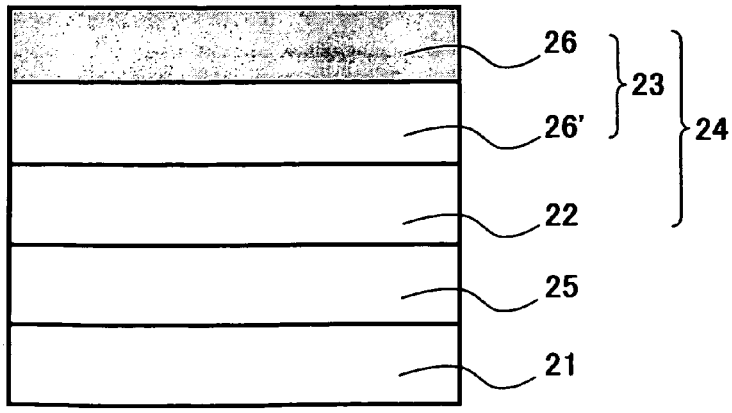

FIG. 11 is a schematic view illustrating the cross section of a still further embodiment of the photoreceptor of the present invention. In the photoreceptor, an undercoat layer 25 is formed between an electroconductive substrate 21 and a CGL 22. In addition, a CTL 23 including a first CTL 26' including no inorganic filler and a filler-reinforced CTL 26 are overlaid on the CGL.

Suitable materials for use as the electroconductive substrate 21 include plastic films, plastic cylinders or papers coated with a material having a volume resistance not greater than $10^{10}$ Ω·cm, for example, metals such as aluminum, nickel, chromium, nichrome, copper, silver, gold, platinum and iron, and metal oxides such as tin oxides and indium oxides by a deposition method or a sputtering method. In addition, plates of a metal such as aluminum, aluminum alloys, nickel and stainless steel can be used. Tubes prepared by tubing such a metal using a method such as drawing ironing methods, impact ironing methods, extruded ironing methods, extruded drawing methods and cutting methods and then treating the surface thereof by cutting, super finishing and polishing, can also be used as the electroconductive substrate 21.

The photosensitive layer 24 may be the mixture type photosensitive layer mentioned above in which a CGM and a CTM are dispersed or the layered photosensitive layer in which a CGL including a CGM and a CTL including a CTM are overlaid. At first, the layered photosensitive layer will be explained.

At first, a charge generation layer (CGL) 22 will be explained. The CGL includes a CGM as a main component, and a binder resin is included therein if desired. As the CGM, inorganic CGMs and organic CGMs can be used.

Specific examples of the inorganic CGMs include crystalline selenium, amorphous selenium, selenium-tellurium alloys, selenium-tellurium-halogen alloys, selenium-arsenic alloys, amorphous silicon, etc. Suitable amorphous silicon includes ones in which a dangling bond is terminated with a hydrogen atom or a halogen atom or in which a boron atom or a phosphorus atom is doped.

Specific examples of the organic CGMs include known CGMs, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like materials. These CGMs can be used alone or in combination.

Specific examples of the binder resin, which is optionally used in the CGL, include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These binder resins can be used alone or in combination.

In addition, charge transport polymers can be used as the binder resin of the CGL. Further, a low molecular weight CTM can be added to the CGL, if desired.

Suitable CTMs for use in the CGL include electron transport materials and positive-hole transport materials. The CTMs may be low molecular weight CTMs or charge transport polymers. Specific examples of the electron transport materials include electron-accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno [1,2-b]thiophene-4-one and 1,3,7-trinitrodibenzothiophene-5,5-dioxides.

These electron transport materials can be used alone or in combination.

Specific examples of the positive-hole transport materials include electron donating materials such as oxazole derivatives, oxadiazole derivatives, imidazole derivatives, triphenylamine derivatives, 9-(p-diethylaminostyrylanthracene), 1,1-bis-(4-dibenzilaminophenyl)propane, styrylanthracene, styrylpyrazoline, phenylhydrazone, α-phenylstilbene derivatives, thiazole derivatives, triazole derivatives, phenazine derivatives, acridine derivatives, benzofuran derivatives, benzimidazole derivatives and thiophene derivatives.

These positive-hole transport materials can be used alone or in combination.

Specific examples of the charge transport polymers include polymers having a carbazole ring such as poly-N-vinyl carbazole; polymers having a hydrozone skeleton as disclosed in JOP 57-78402; polysilylene compounds as disclosed in JOP 63-285552; and aromatic polycarbonate compounds as disclosed in JOPs 8-269183, 9-151248, 9-71642, 9-104746, 9-328539, 9-272735, 9-241369, 11-29634, 11-5836, 11-71453, 9-221544, 9-227669, 9-157378, 9-302084, 9-302085, 9-268226, 9-235367, 9-87376, 9-110976 and 2000-38442.

These charge transport polymers can be used alone or in combination.

Suitable methods for forming the CGL 31 include vacuum thin film forming methods, and casting methods.

Specific examples of such vacuum thin film forming methods include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the CGL include, for example, the following steps:

(1) preparing a coating liquid by mixing one or more inorganic or organic charge generation materials mentioned above with a solvent such as tetrahydrofuran, cyclohexanone, dioxane, dichloroethane and butanone, optionally together with a binder resin and an additives, and then dispersing the materials with a ball mill, an attritor, a sand mill or the like dispersion machine;

(2) coating on a substrate the coating liquid, which is diluted if necessary, by a dip coating method, a spray coating method, a ring coating method, a bead coating method or the like method; and (3) drying the coated liquid to form a charge generation layer.

The thickness of the charge generation layer 31 is preferably from about 0.01 to about 5 μm, and more preferably from about 0.05 to about 2 μm.

Next, the CTL 23 will be explained in detail. When the CTL is an outermost layer, the water vapor permeability of the CTL has to be not greater than 50 $g \cdot m^{-2} \cdot 24\ h^{-1}$ whether or not a filler-reinforced CTL is formed.

At first, a case in which the filler-reinforced CTL 26 is not formed will be explained.

A CTL coating liquid is prepared by mixing an inorganic filler, a binder resin, a low molecular weight CTM (or a charge transport polymer) and a solvent, and pulverizing (or dissociating) the filler to disperse the inorganic filler in the binder resin. The CTL can be formed by coating the CTL liquid and then drying the coated liquid.

Suitable coating methods for use in forming the CTL include dip coating methods, spray coating methods, ring coating methods, roll coating methods, gravure coating methods, nozzle coating methods, screen coating methods, etc.

The thickness of the CTL is preferably from 5 to 50 μm, and more preferably from 5 to 35 μm. If it is desired to produce images having excellent resolution, the thickness is preferably from 5 to 28 μm.

Specific examples of the binder resin for use as the binder resin include known thermoplastic resins and thermosetting resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, polycarbonates, cellulose acetate resins, ethyl cellulose resins, polyvinyl butyral resins, polyvinyl formal resins, polyvinyl toluene, acrylic resins, silicone resins, fluorine-containing resins, epoxy resins, melamine resins, urethane resins, phenolic resins, alkyd resins and the like resins.

These polymers can be used alone or in combination. In addition, copolymers including units formed of two or more of the monomers of these polymers can also be used. Further, copolymers including a unit formed of a charge transport material can also be used.

In particular, when polymers which are electrically inactive are used to decrease the water vapor permeability of the CTL, for example, polyester resins, polycarbonate resins, acrylic resins, polystyrene resins, polyvinyl chloride resins, polyvinylidene chloride resins, polyethylene resins, polypropylene resins, fluorine-containing resins, polyacrylonitrile resins, acrylonitrile/styrene/butadiene copolymers, styrene/acrylonitrile copolymers, ethylene/vinyl acetate copolymers and the like resins are preferably used because of having good gas barrier property. At this point, the electrically inactive polymers mean polymers which do not include a photoconductive group such as triarylamine group.

In addition, electrically inactive repeating units are defined as a repeating unit formed of a monomer which does not have a photoconductive group such as triarylamine group. Specific examples of the monomers include compounds having the following formula (A):

$$HO—X—OH \quad (A)$$

Specific examples of the diol compounds having formula (A) include aliphatic diols such as 1,3-propanediol, 1,4-butanediol, 1,5-pentanediol, 1,6-hexanediol, 1,8-octanediol, 1,10-decanediol, 2-ethyl-1,3-propanediol, 2,2-dimethyl-1,3-propanediol, 2-ethyl-1,3-propanediol, diethylene glycol, triethylene glycol, polyethylene glycol and polytetramethyleneether glycol; alicyclic diols such as 1,4-cyclohexane diol, 1,3-cyclohexane diol, and cyclohexane-1,4-dimethanol; and aromatic diols such as 4,4'-dihydroxydiphenyl, bis(4-hydroxyphenyl)methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl)propane, 1,1-bis(4-hydroxyphenyl)cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxydiphenylsulfone, 4,4'-dihydroxydiphenylsulfoxide, 4,4'-dihydroxydiphenylsulfide, 3,3'-dimethyl-4,4'-dihydroxydiphenylsulfide, 4,4'-dihydroxydiphenyloxide, 2,2-bis(4-hydroxyphenyl)hexafluoropropane, 9,9-bis(4-hydroxyphenyl)fluorene, 9,9-bis(4-hydroxyphenyl)xanthene, ethyleneglycol-bis(4-hydroxybenzoate), diethyleneglycol-bis(4-hydroxybenzoate), triethyleneglycol-bis(4-hydroxybenzoate), 1,3-bis(4-hydroxyphenyl)tetramethyldisiloxane, phenol modified silicone oil and the like.

When these resins are used in combination with a binder resin, the content of the resins is preferably not greater than 50% by weight in view of photo-decay of the resultant photosensitive layer.

For the same reason, when a charge transport polymer is copolymerized with a monomer which forms a unit having a high gas barrier property, the content of the unit is preferably not greater than 60% by weight based on total weight of the CTMs included in the CTL.

When two or more polymers are employed in the CTL, the water vapor permeability of the layer is near the average value of the water vapor permeabilities of the polymers. Therefore, when a polymer is used to decrease the water vapor permeability of the CTL, the film made of only the polymer preferably has a water vapor permeability not greater than 140 $g \cdot m^{-2} \cdot 24\ h^{-1}$ (the water vapor permeability of the polymer having the same thickness as that of the CTL). By using such a polymer, various charge transport materials can be combined. Bisphenol A-form polycarbonate resins, which typically used as a binder resin for photoreceptors, have a water vapor permeability of about 140 $g \cdot m^{-2} \cdot 24\ h^{-1}$.

Specific examples of the CTMs include the low molecular weight electron transport materials and low molecular weight positive-hole transport materials mentioned above, and charge transport polymers.

When a low molecular weight CTM is used, the content of the CTM is preferably from 40 to 200 parts by weight, and more preferably from 60 to 100 parts by weight, per 100 parts by weight of the resin components included in the CTL. When a charge transport polymer is used, copolymers in which a resin unit of from 0 to 500 parts by weight and preferably from 0 to 150 parts by weight is copolymerized with a charge transport unit of 100 parts by weight are preferably used.

When two or more kinds of CTMs are included in the CTL, the difference in ionization potential of the CTMs is preferably little. Specifically, the ionization potential difference is preferably not greater than 0.15 eV. In this case, a problem in which one of the CTMs becomes a trap of the other of the CTMs can be prevented.

In particular, when it is desired to impart high photosensitivity to the photoreceptor, it is preferable that the CTL has a high charge mobility, particularly, at a low electric field. Specifically, it is preferable that any one of the first CTL including no inorganic filler, the filler-reinforced CTL and a CTL in which a first CTL including no inorganic filler and a filler-reinforced CTL are overlaid has a charge mobility not less than $1.2 \times 10^{-5}$ $cm^2/V \cdot sec$ at an electric field of $4 \times 10^5$ V/cm, and in addition, the dependency $\mu$ of the charge mobility on the electric field, which is defined below, is preferably not greater than $1.6 \times 10^{-3}$.

The dependency $\beta$ of the charge mobility on the electric field can be determined as follows.

Figure 13:
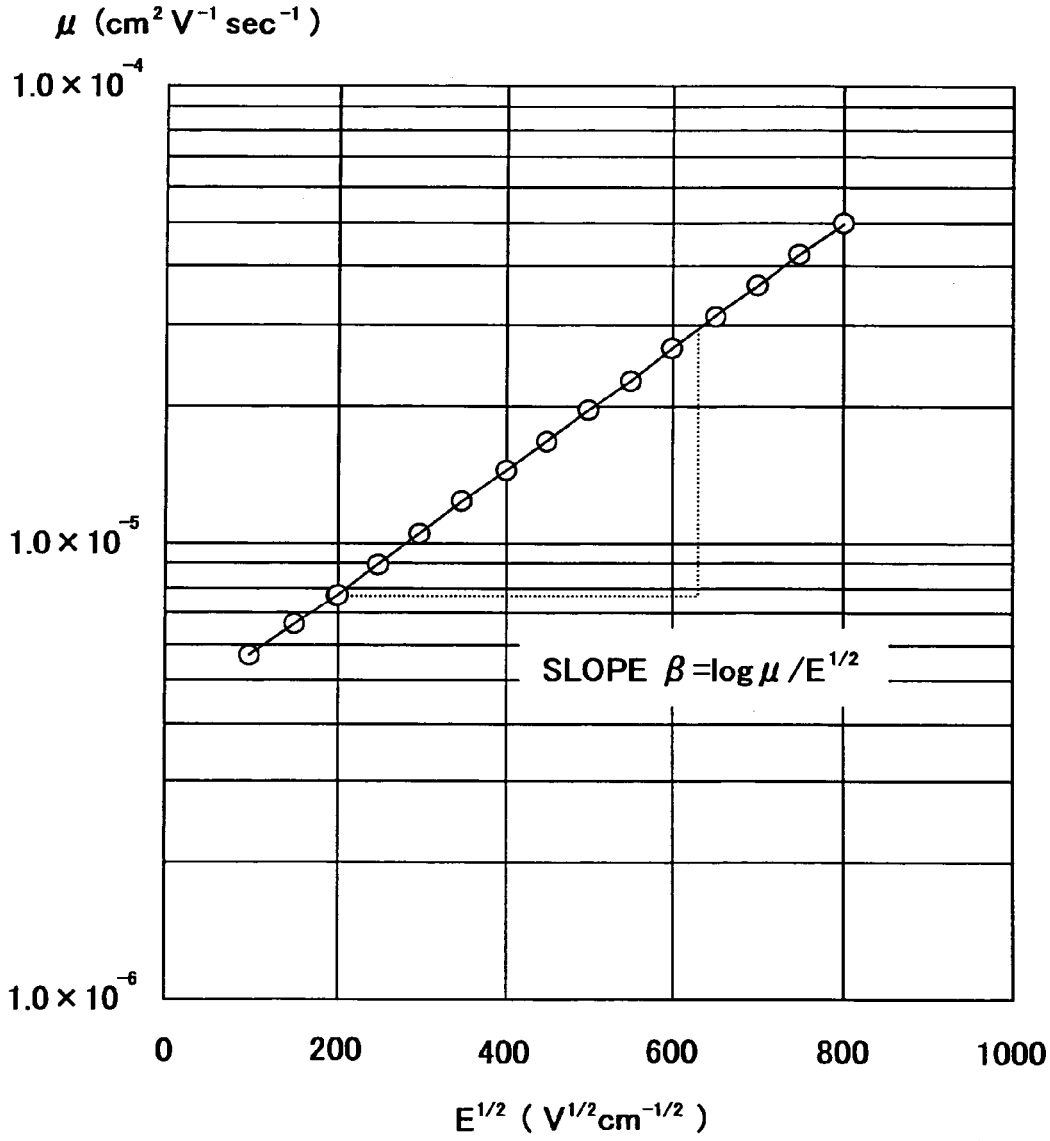
FIG. 13 is a graph for explaining how to determine the dependency of the charge mobility of a charge transport layer on the electric field applied to the charge transport layer.

The charge mobility of a layer is measured while the electric field is changed from low electric field to high electric field. The obtained data are plotted in a graph in which the charge mobility is plotted in vertical axis (unit: $cm^2/V \cdot sec$) and square root of the electric field is plotted in horizontal axis (unit: $V^{1/2}/CM^{1/2}$). Then an approximate line is drawn as shown in FIG. 13. It is interpreted that the larger the slope of the line, the larger the dependency of the charge mobility on the electric field. In the present invention, the dependency $\beta$ of the charge mobility is defined by the following equation (1):

$$\beta = \log \mu / E^{1/2} \quad (1)$$

When a CTL has a large $\beta$, it is said that the dependency of the charge mobility of the CTL on the electric field is high. In almost all cases in which a CTL has a large $\beta$, the charge mobility of the CTL at a low electric field is small. In such cases, problems in that the residual potential increases, and the response of the photoreceptor deteriorates when the photoreceptor is used while the charge potential is controlled so as to be relatively low.

In order to provide a photoreceptor having a high sensitivity, the total content of the CTMs included in the CTL is preferably at least 70 parts by weight per 100 parts by weight of resin components included therein.

Specific examples of the inorganic fillers include titanium oxide, silica, alumina, zinc oxide, zirconium oxide, tin oxide, indium oxide, antimony oxide, magnesium oxide, silicon nitride, boron nitride, calcium oxide, calcium carbonate, barium sulfate, etc.

Among these inorganic fillers, inorganic fillers having a hexagonal close-packed structure are preferably used because of having stable charge properties and imparting good durability to the resultant photoreceptor.

In particular, α-alumina is preferably used because good durability can be imparted to the resultant photoreceptor. This is because α-alumina has a high Mohs hardness next to diamond and a high translucency. Since α-alumina is very hard, to include α-alumina in a photoreceptor is very effective at improving the durability of the photoreceptor. Since α-alumina is translucent, the layer including the filler can efficiently transmit imagewise light and thereby good charge properties can be maintained. In addition, it is possible to include the filler in a layer in a large amount, and therefore the abrasion resistance of the layer can be dramatically improved.

Among α-alumina, the following α-alumina is more preferably used because the filler has good packing property in a film (i.e., in a layer). Therefore, even when the content of the filler is increased, the resultant layer (film) has smooth surface.

Figure 12:
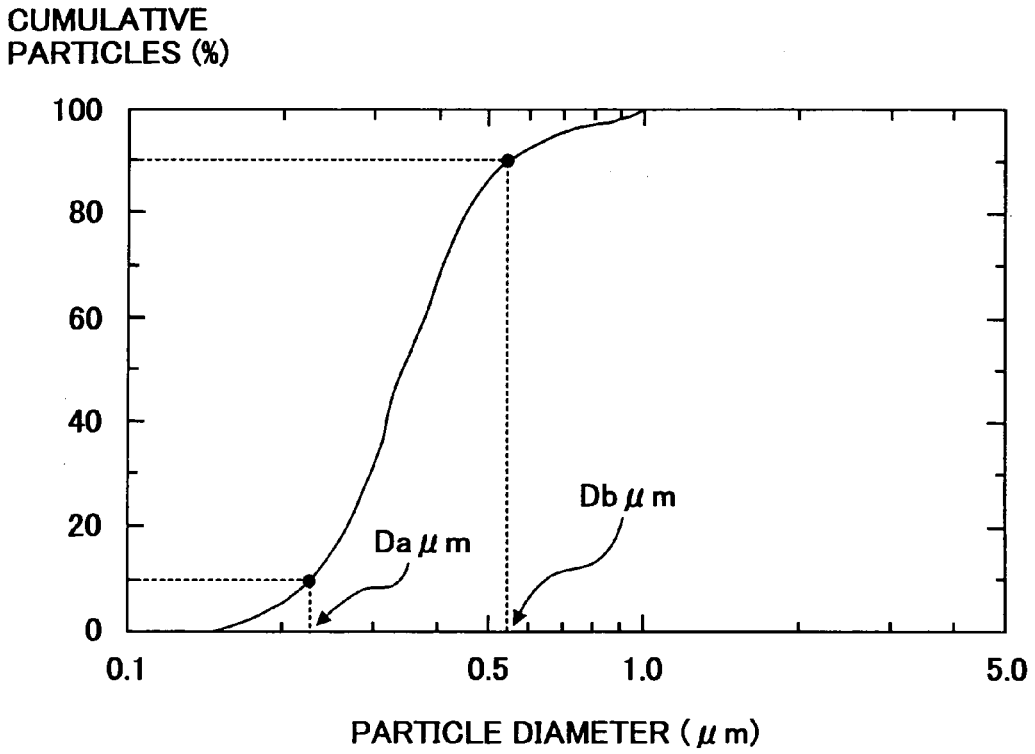
FIG. 12 is a graph for explaining a 10% cumulative particle diameter Da and a 90% cumulative particle diameter Db.

The α-alumina is polyhedral particles substantially having no crush surface. In addition, the α-alumina has a D/H ratio of from 0.5 to 5.0, wherein D represents a maximum particle diameter of the α-alumina in a direction parallel to the hexagonal close-packed lattice plane; and H represents a maximum particle diameter of the α-alumina in a direction vertical to the hexagonal close-packed lattice plane. Further, it is preferable that the α-alumina has an average particle diameter not less than 0.1 μm and less than 0.7 μm, and in addition the α-alumina has a particle diameter distribution such that the following relationship is satisfied:

$$Db/Da \leqq 5$$

wherein Da represents a 10% cumulative particle diameter, wherein particles having the 10% cumulative particle diameter or smaller is present in an amount of 10% by weight; Db represents a 90% cumulative particle diameter, wherein particles having the 90% cumulative particle diameter or smaller is present in an amount of 90% by weight. Da and Db can be determined by a graph as illustrated in FIG. 12. By using such α-alumina, the resultant photoreceptor has excellent durability.

The crush surface of α-alumina often serves as a charge trap, and therefore, α-alumina having a large crush surface is not preferable in view of charge properties of the resultant photoreceptor.

When α-alumina having a large D/H ratio is used, the smoothness of the surface of the resultant photoreceptor deteriorates because the alumina has an irregular form. When the D/H ratio is from 0.5 to 5.0, such a problem can be avoided, namely, the resultant photoreceptor has a smooth surface.

In addition, it is preferable to use α-alumina having a sharp particle diameter distribution. Specifically, it is preferable for the α-alumina to have a particle diameter distribution, which is measured by a Sedi Graph X-ray transmittance particle diameter distribution measuring method, such that Db/Da is not greater than 5, to prepare a layer having a smooth surface.

These fillers may be subjected to a surface treatment to improve dispersion of the filler in the coating liquid or in the resultant layer.

Specific examples of the surface treatment agents include silane coupling agents, silazane, titanate coupling agents, aluminum coupling agents, zirconaluminate coupling agents, zirconium-containing organic compounds, fatty acid compounds, etc.

In addition, in the present invention, the filler may be treated with an inorganic material. Specific examples of such inorganic surface treatment agents include alumina, zirconia, tin oxide, silica, etc.

Among these surface treatment agents, fatty acid compounds and silane coupling agents are preferably used because imparting good dispersibility to the filler and improving the electrostatic properties of the resultant photoreceptor.

The surface treatment of fillers can be performed by a know method such as reforming using a coating method; reforming using a mechano-chemical method; reforming using a topochemical method; reforming using an encapsulation method; reforming using high energy; and reforming using a precipitation reaction.

In order to decrease the residual potential and potential of a lighted portion of the photoreceptor, a resistivity decreasing agent may be added in the CTL.

Specific examples of the resistivity decreasing agents include partial esters of a polyhydric alcohol and a fatty acid (e.g., mono-fatty acid esters of sorbitan and fatty acid esters of pentaerythritol), adducts of aliphatic alcohols with ethylene oxide, adducts of fatty acids with ethylene oxide, adducts of alkylphenols with ethylene oxide, adducts of partial esters of a polyhydric alcohol and a fatty acid with ethylene oxide, carboxylic acids derivatives, etc.

These compounds can be used alone or in combination.

The content of the resistivity decreasing agent is preferably from 0.5 to 10 parts by weight per 100 parts by weight of the filler included in the CTL.

Inorganic fillers can be pulverized and dispersed using a dispersing machine such as ball mills, vibration mills, sand mills, Keddy mills, three roll mills, pressure homogenizers, ultrasonic dispersing machines, etc.

When the inorganic filler used includes many large particles, the large particles project their tops from the outermost layer, and thereby the cleaning blade is damaged, resulting in incomplete cleaning. Therefore, fillers having an average particle diameter of from 0.05 to 3.0 μm are preferably used. It is more preferable to use a filler having an average particle diameter of from 0.1 to 0.7 μm or to pulverize (or dissociate) a filler such that the filler has an average particle diameter of from 0.1 to 0.7 μm in the resultant layer.

The content of a filler in the CTL is preferably from 5 to 50% by weight. When the content is too low, good abrasion resistance cannot be imparted to the resultant photoreceptor. To the contrary, when the content is too high, it is impossible to prepare a layer having a smooth surface.

In conventional photoreceptors, when the content of an inorganic filler in the photosensitive layer thereof exceeds 5%, the resultant photoreceptors have drawbacks in that the photosensitivity deteriorates and the residual potential increase. Therefore such photoreceptors cannot be practically used. By changing the filler content in a layer such that the filler content at the surface side is greater than that at the bottom side, such problems concerning electrostatic properties can be avoided while a good abrasion resistance is imparted to the resultant photoreceptor.

In this case, the thickness (i.e., a thickness t illustrated in FIG. 4) of a portion of the outermost layer, in which an inorganic filler is included, is preferably from 0.5 to 10 μm, and more preferably from 2 to 10 μm. When the thickness is too thin, the abrasion improving effect is little. When the thickness is not less than 2 μm, the resultant photoreceptor has almost the same life as those of the other parts of typical image forming apparatus. When the thickness is too thick, the manufacturing costs of the photoreceptor increase. Therefore, the thickness is preferably not greater than 10 μm.

The pigment-content gradient CTL mentioned above can be formed, for example, by the following method:

(1) a first photosensitive layer coating liquid including no filler or a small amount of a filler is coated and optionally dried; and (2) a second photosensitive layer coating liquid including a large amount of the filler or another filler is coated thereon and dried.

As a specific embodiment of the method, a solution diffusion method is disclosed by Uetoshi et-al in Polymer Preprints, Japan, 46, No. 11, 2689, 1997. The solution diffusion method is as follows:

(1) at first a coating liquid including no inorganic filler is coated to form a first layer; and (2) a second coating liquid including an inorganic filler is coated on the coated first layer while the coated first layer is heated to a temperature higher than the boiling point of the solvent included in the first layer coating liquid.

Thus, a filler-content gradient layer which has a structure similar to the outermost layer shown in FIGS. 4, 5, 8 and 9 can be formed.

The thus formed CTL layers do not have a clear interface even when the two coating liquids are coated, and in addition filler concentration gradient is formed in the thickness direction of the layer.

The photoreceptor of the present invention may have the structure as shown in FIGS. 6, 7, 10 and 11 in which a photosensitive layer including an inorganic filler is formed on a photosensitive layer which does not include an inorganic filler or includes a small amount of an inorganic filler. Such a photosensitive layer can be prepared by coating at first a first (CTL) coating liquid including no filler and drying, and then coating a second (CTL) coating liquid including an inorganic filler thereon.

The CTL may include a low molecular weight compound such as antioxidants, plasticizers, lubricants and ultraviolet absorbents, and/or a leveling agent. These materials can be used alone or in combination.

The content of the low molecular weight compounds is from 0.1 to 150 parts by weight, and preferably from 0.1 to 30 parts by weight, per 100 parts by weight of high molecular weight compounds (such as binder resins) included in the CTL. The content of the leveling agents is from 0.001 to 5 parts by weight per 100 parts by weight of high molecular weight compounds included in the CTL.

Next, the CTL 26' including no inorganic filler, which is used in the case in which a filler-reinforced CTL 26 is formed thereon, will be explained.

The CTL 26' including no inorganic filler is a layer of the functionally-separated layered CTL 23, on which a filler-reinforced CTL 26 mentioned below is to be formed. The CTL 26' may include an inorganic filler in such an amount that the electrostatic properties are not affected thereby. The pigment content in the CTL 26' is preferably less than 5% by weight.

The CTL 26' can be formed by a method similar to the method of forming the CTL 23 mentioned above (i.e., by using one or more of the polymers mentioned above for use as the binder resin of the CTL 23, and one of the coating methods mentioned above for use in the CTL 23).

The total thickness of the CTL 26' and CTL 26 is preferably from 5 to 50 μm, and more preferably from 5 to 35 μm. When resolution of images is considered to be important, the thickness is preferably from 5 to 28 μm.

The CTMs mentioned above for use in the CTL 23 can also be used in the CTL 26'. In addition, the CTL 26' may include one or more additives mentioned above for use in the CTL 23. The content of the low molecular weight compounds is from 0.1 to 150 parts by weight, and preferably from 0.1 to 100 parts by weight, per 100 parts by weight of high molecular weight compounds (such as binder resins) included in the CTL 26'. The content of the leveling agent is from 0.001 to 5 parts by weight per 100 parts by weight of high molecular weight compounds included in the CTL 26'.

Then the filler-reinforced CTL 26 will be explained.

The filler-reinforced CTL 26 includes at least a CTM, a binder resin and an inorganic filler. The CTL 26 has a functional layer having a combination of good charge transport ability and good mechanical durability. The CTL 26 has a high charge mobility which is almost the same as that of conventional CTLs, and therefore the CTL 26 is different from a conventional protective layer.

The filler-reinforced CTL 26 is used as an outermost layer of a layered photoreceptors including a functionally-separated CTL having plural layers. Namely the CTL 26 is used in combination with the CTL 26' including no inorganic filler, i.e., the CTL 26 is not used alone. Therefore the CTL 26 is distinguished from single CTLs in which an inorganic filler is dispersed as an additive.

As the filler for use in the filler-reinforced CTL 26, the inorganic fillers mentioned above for use in the CTL 23 can also be used. In particular, inorganic fillers having a hexagonal close-packed structure are preferably used, and among the fillers, α-alumina is more preferable. Similarly to the above-mentioned CTL, the inorganic fillers may be treated with a surface treatment agent to improve the dispersibility thereof.

A coating liquid for the filler-reinforced CTL 26 can be prepared by mixing an inorganic filler, a binder resin, a low molecular weight CTM (or a charge transport polymer) and a solvent, and then dispersing them.

As the binder resin, the materials mentioned above for use in the CTL 23 can be used. As the CTM, the materials mentioned above for use in the CTL 23 can also be used. The preferable ranges of the content of these materials are the same as those mentioned above in the CTL 23.

In particular, it is very important to include a CTM in the filler-reinforced CTL 26 to avoid deterioration of photosensitivity and increase of residual potential.

As the solvent used in the filler-reinforced CTL 26 coating liquid, the solvents (e.g., ketones, ethers, aromatic solvents, halogen-containing solvents and esters) mentioned above for use in the CTL 23 coating liquid can also be used.

Fillers used in the CTL 26 coating liquid can also be pulverized and dispersed by one of the dispersing machines mentioned above for use in preparation of the CTL 23 coating liquid. In addition, the filler used in the CTL 26 coating liquid preferably has the particle diameter and particle diameter distribution mentioned above in the CTL 23.

As the binder resin of the filler-reinforced CTL 26, acrylic resins, polyester resins, polycarbonate resins, polyarylate resins, polyamide resins, polyurethane resins, polystyrene resins, epoxy resins, etc., can also be used.

The content of a filler in the CTL 26 is preferably from 5 to 50% by weight, and more preferably from 10 to 50% by weight. When the content is too low, good abrasion resistance cannot be imparted to the resultant photoreceptor. To the contrary, when the content is too high, it is impossible to prepare a layer having a smooth surface.

In conventional photoreceptors, when the content of an inorganic filler in the photosensitive layer thereof exceeds 5%, the resultant photoreceptors have drawbacks in that the photosensitivity deteriorates and the residual potential increase. Therefore such photoreceptors cannot be practically used. By forming a filler-reinforced CTL, such problems concerning electrostatic properties can be avoided while a good abrasion resistance is imparted to the resultant photoreceptor.

The thickness of the CTL 26 is preferably from 0.5 to 10 μm, and more preferably from 2 to 10 μm. When the thickness is too thin, the abrasion improving effect is little. When the thickness is not less than 2 μm, the resultant photoreceptor has almost the same life as those of other parts of image forming apparatus. When the thickness is too thick, the manufacturing costs of the photoreceptor increase. Therefore, the thickness is preferably not greater than 10 μm.

When the thickness of a conventional CTL including an inorganic filler is increased, the photosensitivity of the resultant photoreceptor deteriorates and the residual potential thereof increases. However, since the CTL of the photoreceptor of the present invention is functionally separated, and therefore such problems concerning electrostatic properties can be avoided.

The filler-reinforced CTL 26 can be prepared by one of the methods mentioned above for use in preparation of the CTL 23. In particular, spray coating methods and ring coating methods are preferably used for forming the CTL 26 because photoreceptors having good qualities can be stably produced.

It is preferable that the CTL 26 is formed on the CTL 26' such that there is no clear interface between the layers (i.e., a continuous layer is formed) to prevent the CTL 26 from being peeled from the CTL 26' and to prevent formation of an electric barrier.

In this case, the thickness (i.e., the thickness TF as illustrated in FIG. 10) of the filler-reinforced CTL 26 is defined as the thickness of a filler-including portion of the CTL 23, which includes an inorganic filler.

It is preferable that the thickness TF is uniform in the entire photosensitive layer. Specifically, when the cross section of the photosensitive layer is observed using a scanning electron microscope (SEM) of about 2,000 power magnification to determine the thickness TF at 20 points which are sampled from the cross section at an interval of 5 μm, the standard deviation of the thickness TF is preferably not greater than ⅕ of the average thickness. In particular, in a case in which priority is given to image qualities, the standard deviation of the thickness TF is preferably not greater than ⅐ of the average thickness.

The CTL having such a structure can be formed by using a coating liquid fulfilling the following conditions (a) and (b) as the filler-reinforced CTL coating liquid.

(a) the solvent used can fully dissolve the resin used therein; and (b) the filler-reinforced CTL 26 satisfies the following relationship:

$$1.2<(X/Y)<2.0$$

wherein X represents the difference between the weight of the photoreceptor before the CTL 26 is not coated and the weight of the photoreceptor which has been allowed to settle for 1 hour without being heated after the CTL is coated, and Y represents the difference between the weight of the photoreceptor before the CTL 26 is not coated and the weight of the photoreceptor which is heated after the CTL is coated to dry the CTL 26.

When the CTL 26 coating liquid fulfills the above-mentioned conditions, the resultant CTL 26 can impart good durability to the resultant photoreceptor.

Next, the mixture type photosensitive layer 24 will be explained.

The mixture type photosensitive layer 24 has a water vapor permeability not greater than 50 $g \cdot m^{-2} \cdot 24\ h^{-1}$, whether or not the filler-reinforced mixture type photosensitive layer is formed.

The mixture type photosensitive layer can be typically formed by the following method:

(1) constituents of the photosensitive layer are dissolved or dispersed in a proper solvent to prepare a coating liquid; and (2) the coating liquid is coated and dried to form the mixture type photosensitive layer.

The mixture type photosensitive layer 24 is prepared by one of the coating methods mentioned above for use in preparation of the CTL 23 such that the filler content at the surface side is greater than that at the bottom side thereof.

In addition, the materials mentioned above for use in the CTL 23, such as binder resins, CGMs, CTMs and inorganic fillers, can also be used in the mixture type photosensitive layer 24.

Further, the additives mentioned above for use in the CTL 23, such as antioxidants, plasticizers, lubricants, ultraviolet absorbents and leveling agents, can also be used in the mixture type photosensitive layer 24. In addition, the preferable ranges of the content of these additives are the same as those in the CTL 23.

The thickness of the mixture type photosensitive layer 24 is preferably from 5 to 50 μm, and more preferably from 10 to 35 μm. If it is desired to produce images having excellent resolution, the thickness is preferably from 10 to 28 μm.

The thickness of a filler-including portion in the mixture type photosensitive layer 24, in which an inorganic filler is included, is preferably from 0.5 to 10 μm, and more preferably from 2 to 10 μm for the same reason as mentioned above.

Then a mixture type photosensitive layer 27' including no filler, which is formed below the filler-reinforced photosensitive layer 27, will be explained.

The mixture type photosensitive layer 27' including no inorganic filler is a layer of the functionally-separated layered photosensitive layer 24, on which a filler-reinforced photosensitive layer 27 mentioned below is to be formed. The photosensitive layer 27' may include an inorganic filler in such an amount that the electrostatic properties are not affected thereby. The pigment content in the photosensitive layer 27' is preferably less than 5% by weight.

The photosensitive layer 27' can be formed by a method similar to the method of forming the photosensitive layer 24 mentioned above. As the coating method, one of the coating methods mentioned above for use in the CTL 23 can also be used.

In addition, the materials mentioned above for use in the CTL 23, such as binder resins, CGMS, CTMs and inorganic fillers, can also be used in the mixture type photosensitive layer 27' Further, the additives mentioned above for use in the CTL 23, such as antioxidants, plasticizers, lubricants, ultraviolet absorbents and leveling agents, can also be used in the mixture type photosensitive layer 27'.

The content of the additives such as antioxidants, plasticizers, lubricants and ultraviolet absorbents is preferably from 0.1 to 200 parts by weight, and more preferably from 0.1 to 150 parts by weight, per 100 parts by weight of polymers included in the layer. The content of the leveling agent is preferably from 0.001 to 5 parts by weight per 100 parts by weight of polymers-included in the layer.

The thickness of the photosensitive layer 27' is preferably from 5 to 50 μm, and more preferably from 10 to 35 μm. When priority is given to resolution of images, the thickness is preferably from 10 to 28 μm.

Then the filler-reinforced mixture type photosensitive layer 27 will be explained.

The filler-reinforced mixture type photosensitive layer 27 includes at least a binder resin, an inorganic filler, a CGM and a CTM. The mixture type photosensitive layer 27 has a functional layer having a combination of good charge transport ability, good charge generation ability and good mechanical durability. The mixture type photosensitive layer 27 has a high charge mobility which is almost the same as that of conventional photosensitive layers, and therefore the mixture type photosensitive layer 27 is different from a protective layer.

The mixture type photosensitive layer 27 is used as an outermost layer of a layered photoreceptors including a functionally-separated mixture type photosensitive layer having plural layers. Namely the photosensitive layer 27 is used in combination with the photosensitive layer 27' including no inorganic filler, i.e., the photosensitive layer 27 is not used alone. Therefore the photosensitive layer 27 is distinguished from single-layer mixture type photosensitive layers in which an inorganic filler is dispersed as an additive.

The filler-reinforced mixture type photosensitive layer 27 can be formed by a method similar to the method mentioned above for use in the filler-reinforced CTL 26 except that a CGM is added therein if necessary.

The CGMs mentioned above for use in the CGL can also be used.

The thickness of the filler-reinforced mixture type photosensitive layer 27 is preferably from 0.5 to 10 μm, and more preferably from 2 to 10 μm.

The photoreceptor of the present invention may include an undercoat layer 25 which is formed between the electroconductive substrate 21 and the mixture type photosensitive layer 24 or the CGL 22. The undercoat layer is formed, for example, to improve adhesion of the photosensitive layer to the substrate 21, to prevent moire in the resultant image, to improve the coating quality of the upper layer, to decrease residual potential in the resultant photoreceptor, and/or to prevent charge injection from the substrate 21 to the photosensitive layer.

The undercoat layer 25 mainly includes a resin. Since a photosensitive layer coating liquid, which typically includes an organic solvent, is coated on the undercoat layer, the resin used in the undercoat layer preferably has good resistance to popular organic solvents.

Specific examples of such resins for use in the undercoat layer include water-soluble resins such as polyvinyl alcohol, casein and sodium polyacrylate; alcohol-soluble resins such as nylon copolymers, and methoxymethylated nylons; and crosslinkable resins such as polyurethane resins, melamine resins, alkyd-melamine resins, and epoxy resins.

In addition, the undercoat layer 25 may include a fine powder such as metal oxides (e.g., titanium oxide, silica, alumina, zirconium oxide, tin oxide, and indium oxide), metal sulfides, and metal nitrides. When the undercoat layer 25 is formed using these materials, known coating methods using a proper solvent can be used similarly to the photosensitive layer.

In addition, a metal oxide layer which is formed, for example, by a sol-gel method using a silane coupling agent, titanium coupling agent or a chromium coupling agent can also be used as the undercoat layer.

Further, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, are also preferably used as the undercoat layer.

The thickness of the undercoat layer 25 is preferably from 0.1 to 5 μm.

In the present invention, each layer of the photoreceptor may include an additive such as antioxidants, plasticizers, lubricants, ultraviolet absorbents, low molecular weights CTMs and leveling agents.

Specific examples of the antioxidants include the following.

(a) Phenolic Compounds 2,6-di-t-butyl-p-cresol, 2,4,6-tri-t-butylphenol, n-octadecyl-3-(4'-hydroxy-3',5'-di-t-butylphenol)propionate, styrenated phenol, 4-hydroxymethyl-2,6-di-t-butylphenol, 2,5-di-t-butylhydroquinone, cyclohexyl phenol, butylhydroxyanisole, 2,2'-methylene-bis-(4-ethyl-6-t-butylphenol), 4,4'-isopropylidenebisphenol, 1,1-bis(4-hydroxyphenyl)cyclohexane, 4,4'-methylene-bis(2,6-di-t-butylphenol), 2,6-bis(2'-hydroxy-3'-t-butyl-5'-methylbenzyl)-4-methylphenol, 1,1,3-tris-(2-methyl-4-hydroxy-5-t-butylphenyl)butane, 1,3,5-trismethyl-2,4,6-tris(3,5-di-t-butyl-4-hydroxybenzyl)benzene, tetrakis-[methylene-3-(3',5'-di-t-butyl-4-hydroxyphenyl)propionate]methane, tris(3,5-di-t-butyl-4-hydroxyphenyl)isocyanate, tris[β-(3,5-di-t-butyl-4-hydroxyphenyl)propionyl-oxyethyl]isocyanate, 4,4'-thiobis(4-methyl-6-t-butylphenol), 4,4'-thiobis(4-methyl-6-t-butylphenol,)etc.

(b) Amine Compounds phenyl-α-naphthylamine, phenyl-β-naphthylamine, N,N'-diphenyl-p-phenylenediamine, N,N'-di-β-naphthyl-p-phenylenediamine, N-cyclohexyl-N'-phenyl-p-phenylenediamine, N-phenylene-N'-isopropyl-p-phenylenediamine, aldol-α-naphthylamine, 6-ethoxy-2,2,4-trimethyl-1,2-dihydroquinoline, etc.

(c) Sulfur-containing Compounds thiobis(β-naphthol), thiobis(N-phenyl-β-naphthylamine), 2-mercaptobenzothiazole, 2-mercaptobenzimidazole, dodecylmercaptan, tetramethylthirammonosulfide, tetramethylthiramdisulfide, nickeldibutylthiocarbamate, isopropylxanthate, dilaurylthiodipropionate, distearylthiodipropionate, etc.

(d) Phosphorus-containing Compounds triphenyl phosphite, diphenyldecyl phosphite, phenyl isodecyl phosphite, tri(nonylphenyl)phosphite, 4,4'-butylidene-bis(3-methyl-6-t-butylphenyl-ditridecylphosphite), distearyl-pentaerythritol diphosphite, trilauryl trithiophosphite, etc.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides

Stearic acid amide, palmitic acid amide, oleic acid amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy)acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

The low molecular weight CTMs mentioned above for use in the CGL 22 can also be used in each layer of the photoreceptor of the present invention.

Then the image forming apparatus of the present invention will be explained referring to figures.

FIG. 1 is a schematic view illustrating an embodiment of the image forming apparatus of the present invention. The image forming apparatus of the present invention is not limited thereto and the modified embodiments mentioned below are also included therein.

In FIG. 1, a photoreceptor 11 is the photoreceptor of the present invention in which a mixture type photosensitive layer or a layered photosensitive layer is formed on an electroconductive substrate optionally with an undercoat layer therebetween. The photosensitive layer includes at least a CGM, a CTL and an inorganic filler, and the filler content is higher at the surface side of the photosensitive layer than that at the bottom side (i.e., the side near the electroconductive substrate). In addition, the outermost layer of the photoreceptor has a water vapor permeability not greater than 50 $g \cdot m^{-2} \cdot 24\ h^{-1}$.

Around the photoreceptor 11, a charger 12 (a charging roller) configured to charge the photoreceptor 11 which rotates in a direction indicated by an arrow; an image irradiator 13 configured to irradiate the photoreceptor 11 with imagewise light to form an electrostatic latent image; an image developer 14 configured to develop the latent image with a developer 15 including a toner to form a toner image on the photoreceptor 11; an image transfer device 16 configured to transfer the toner image onto a receiving material 18; a cleaner 17 configured to clean the surface of the photoreceptor 11; and a discharger 20 configured to discharge the charge remaining on the photoreceptor 11, are arranged. Numeral 19 denotes a fixer configured to fix the toner image to the receiving material 18.

The photoreceptor has a drum form, however, sheet-form or endless-belt-form photoreceptors can also be used in the present invention.

As the charger 12, known chargers such as corotrons, scorotrons, solid state chargers and charging rollers can be used. In the present invention, contact chargers, or proximity chargers which are arranged closely to the photoreceptor while a proper gap (from about 10 μm to about 200 μm) is formed between the surface of the photoreceptor and the surface of the roller, are preferably used. In particular, proximity chargers are preferable because the photoreceptor used can be prevented from being contaminated.

However, it is pointed out that the amount of ozone and NOx produced by proximity chargers is a few times that in the case using contact chargers. Therefore, when proximity chargers are used, measures against deterioration of the photoreceptor caused by such acidic gasses have to be taken. The photoreceptor of the present invention has low gas permeability and therefore the photoreceptor is hardly affected by the gasses. Namely, the advantage of the proximity chargers can be fully exerted.

Similarly, chargers such as corotrons and scorotrons also produce a large amount of ozone. Therefore the properties of conventional photoreceptors are affected thereby. However, the photoreceptor of the present invention has low gas permeability and therefore the photoreceptor is hardly affected by such chargers.

As the image transfer device 16, the above-mentioned chargers can be used. Among the chargers, a combination of a transfer charger and a separating charger is preferably used.

Suitable light sources for use in the image irradiator 13 and the discharger 20 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

When the toner image formed on the photoreceptor 11 by the image developer 14 is transferred onto the receiving material 18, all of the toner image is not transferred onto the receiving material 18, and residual toner particles remain on the surface of the photoreceptor 11. The residual toner is removed from the photoreceptor 11 by the cleaner 17. Specific examples of the cleaner include cleaning blades made of a rubber, and brushes such as fur brushes and mag-fur brushes.

When the photoreceptor 11 which is previously charged positively (or negatively) is exposed to imagewise light, an electrostatic latent image having a positive or negative charge is formed on the photoreceptor 11. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. As the developing method, known developing methods can be used. In addition, as the discharging method, known discharging methods can also be used.

Figure 2:
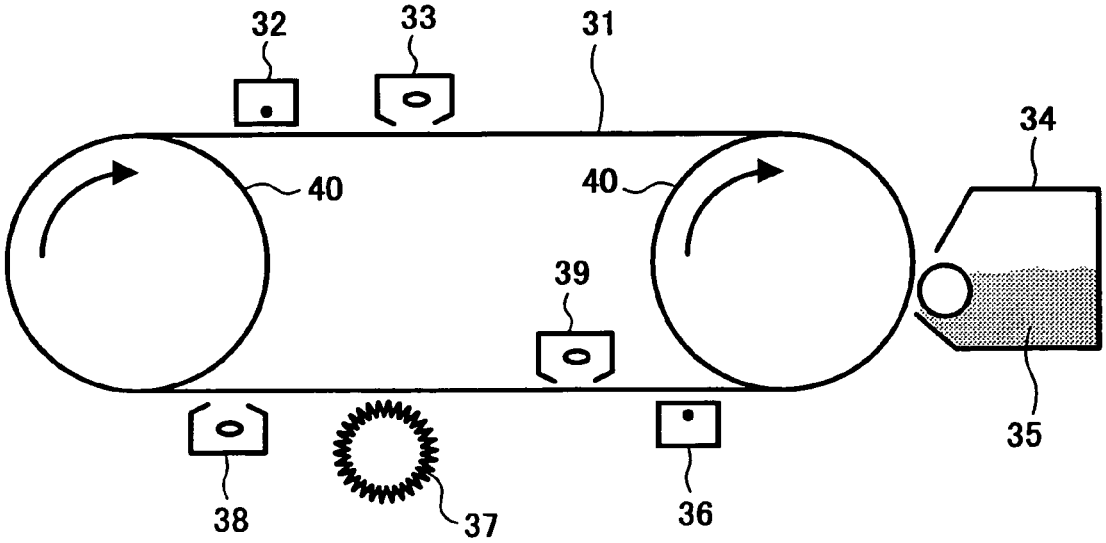
FIG. 2 is a schematic view illustrating another embodiment of the image forming apparatus of the present invention.

FIG. 2 is a schematic view illustrating another embodiment of the image forming apparatus of the present invention.

In FIG. 2, a belt photoreceptor 31 is the photoreceptor of the present invention in which a mixture type photosensitive layer or a layered photosensitive layer is formed on an electroconductive substrate optionally with an undercoat layer therebetween. The photosensitive layer includes at least a CGM, a CTL and an inorganic filler, and the filler content is higher at the surface side of the photosensitive layer than that at the bottom side (i.e., the side near the electroconductive substrate). In addition, the outermost layer of the photoreceptor has a water vapor permeability not greater than 50 $g \cdot m^{-2} \cdot 24\ h^{1}$.

Around the belt photoreceptor 31, a charger 32 configured to charge the photoreceptor 31; an image irradiator 33 configured to irradiate the photoreceptor 31 with imagewise light to form an electrostatic latent image; an image developer 34 configured to develop the latent image with a developer 35 including a toner to form a toner image on the photoreceptor 31; an image transfer device 36 configured to transfer the toner image onto a receiving material; a cleaner 37 configured to clean the surface of the photoreceptor 31; and a discharger 38 configured to discharge the charge remaining on the photoreceptor 31, are arranged. Numeral 40 denotes driving means for rotating the belt photoreceptor 31. Numeral 39 denotes a pre-cleaning irradiator configured to irradiate the photoreceptor 31 such that remaining toner particles can be effectively removed. As illustrated in FIG. 2, the pre-cleaning irradiator irradiates the photoreceptor 31 from the backside of the photoreceptor 31. Therefore, the substrate of the photoreceptor has to be translucent in this case.

The image forming apparatus of the present invention is not limited to the image forming units as shown in FIGS. 1 and 2. For example, in FIG. 2, the pre-cleaning light irradiating operation can be performed from the photosensitive layer side of the photoreceptor 31. In addition, the light irradiation in the light image irradiating process and the discharging process may be performed from the substrate side of the photoreceptor 31.

As light irradiation processes, the image irradiation process, pre-cleaning irradiation process, and discharging process are performed as mentioned above. In addition, a pre-transfer light irradiation operation, which is performed before transferring the toner image, and a preliminary light irradiation operation, which is performed before the image irradiation, and other light irradiation operations may also be performed.

The above-mentioned image forming unit may be fixedly set in an image forming apparatus such as copiers, facsimiles or printers. However, the image forming unit may be set therein as a process cartridge. The process cartridge means an image forming unit (or device) which includes a photoreceptor, and at least one of a charger, an image irradiator, an image developer, an image transfer device, a cleaner, and a discharger.

Figure 3:
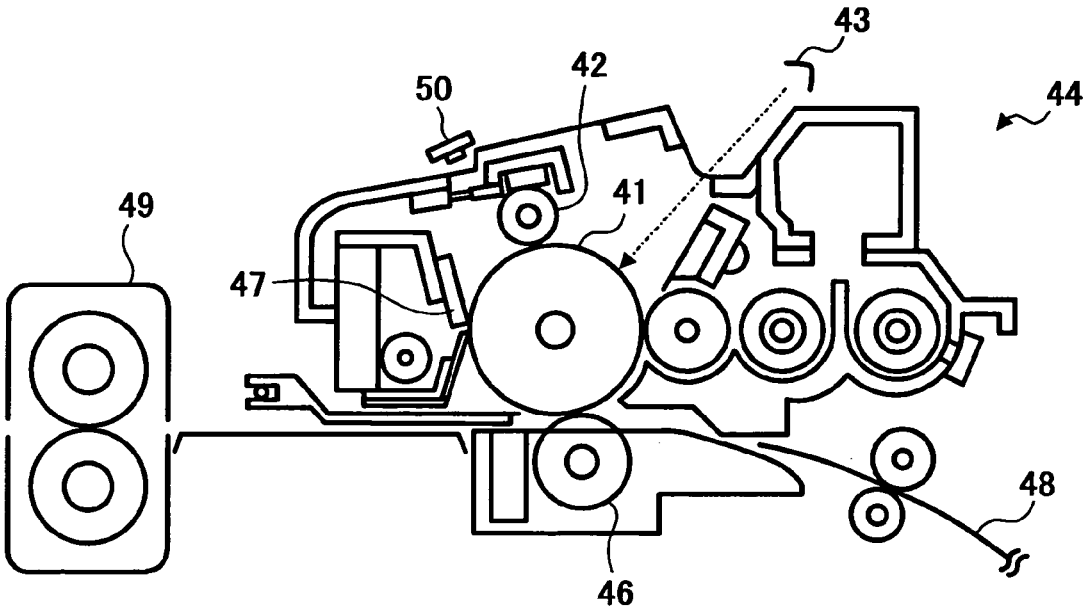
FIG. 3 is a schematic view illustrating yet another embodiment of the image forming apparatus of the present invention.

Various process cartridges can be used in the present invention. An embodiment of the process cartridge of the present invention is illustrated in FIG. 3. In FIG. 3, numeral 41 denote the photoreceptor of the present invention. Similarly to the image forming apparatus as illustrated in FIG. 1, a charger 42, an image irradiator 43, an image developer 44, an image transfer device 46, a cleaner 47 and a discharger 50 are arranged around the photoreceptor 41. Numerals 48 and 49 denote a receiving material and a fixer, respectively.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

At first, measurement methods of the water vapor permeability, thickness, ionization potential and mobility will be explained.

(1) Water Vapor Permeability

Each outermost layer coating liquid was coated on an aluminum plate having a smooth surface and dried to form an outermost layer thereon. The thickness of each of the thus prepared outermost layers was the same as that of each photoreceptor of Examples 1 to 34 and Comparative Examples 1 to 14. Each layer formed on the aluminum plate was peeled from the aluminum plate and then the water vapor permeability was measured with a water vapor permeability measuring apparatus L80-4000 (manufactured by LYSSY Co.). The measuring method was as follows:

Measuring Method

Measurements were performed by a method using a humidity sensor and based on JIS K7192, "A testing method for measuring water vapor permeability of plastic films and sheets (mechanical measuring method)". Measurements were performed at a temperature of 40±0.5° C.

(2) Thickness of Photoconductive Layer

The total thickness of the undercoat layer and photosensitive layer (the mixture type photosensitive layer or layered photosensitive layer) of each photoreceptor was measured with an eddy current type thickness measuring apparatus FISCHER SCOPE MMS (manufactured by Fischer Co.). The total thickness of each photoreceptor was determined by measuring the thickness of points of the photoreceptor at intervals of 1 cm in the longitudinal direction of the photoreceptor and then averaging the thickness.

(3) Ionization Potential of CTM

The ionization potential of a CTM can be measured by two methods, one of which is to directly measure the ionization potential of a powder of the CTM and the other of which is to measure the ionization potential of a layer including the CTM and a binder resin. In the present invention, the ionization potential is measured by the latter method. Namely, the ionization potential of a photosensitive layer including a CTM is considered to be the ionization potential of the CTM. Specifically the measuring method is as follows.

A CTL coating liquid whose formulation is mentioned below was prepared such that the mixing ratio of the CTM and binder resin is constant. The CTL coating liquid was coated on an aluminum plate having a smooth surface and then dried. Thus a sample for measurements of ionization potential was prepared. When two or more kinds of CTMs are included in a layer or layered CTLs, a coating liquid in which the CTMs and a resin are mixed at a ratio of 3:4 was prepared.

Ionization potential was measured using an atmospheric ultraviolet photoelectron analyzer AC-1 manufactured by Riken Keiki Co., Ltd.

(4) Charge Mobility

A CTL coating liquid whose formulation is mentioned below was prepared and the CTL coating liquid was coated on an aluminum layer deposited on a polyethyleneterephthalate film and then dried. The thickness of the CTL was 10 μm. Then a gold layer having a thickness of 200 Å was deposited on the CTL. Thus a sample was prepared.

The charge mobility of the layer was measured at an environment of 25° C. 50% RH using a method using time-of-flight techniques. Specifically, the method is as follows:

A positive voltage was applied to the aluminum electrode. A nitrogen gas laser irradiates the sample from the gold electrode side. The change of the potential caused by photocurrent flowing a resistance inserted between the gold electrode and an earth electrode was recorded in a digital memory.

Two tangent lines are drawn at the front and back sides of the waveform output by the digital memory. A transit time is determined based on the intersection point of the two tangent lines. Specifically, the waveform is plotted in a logarithmic scale graph, and the transit time t is determined based on the intersection point of the two tangent lines of the logarithmic waveform.

The charge mobility μ was determined by the following equation (2):

$$\mu = L^2/(V \cdot t) \quad (2)$$

wherein L represents the thickness of the layer; V represents applied voltage; and t represents the transit time.

Example 1

Formation of Undercoat Layer

The following components were mixed to prepare an undercoat layer coating liquid.

| | |
|---|---|
| Alkyd resin solution (BEKKOZOL 1307-60-EL, manufactured by Dainippon Ink and Chemicals Inc.) | 10 |
| Melamine resin (SUPER BEKKAMINE G-821-60, manufactured by Dainippon Ink and Chemicals Inc.) | 7 |
| Titanium oxide (CR-EL manufactured by Ishihara Sangyo Kaisha Ltd.) | 40 |
| Methyl ethyl ketone | 200 |

The undercoat layer coating liquid was coated on an aluminum drum having a diameter of 30 mm and then dried. Thus, an undercoat layer having a thickness of 3.5 μm was prepared.

Formation of CGL

The following components were mixed to prepare a CGL coating liquid.

| | |
|---|---|
| Bisazo pigment having the following formula (A) | 2.5 |

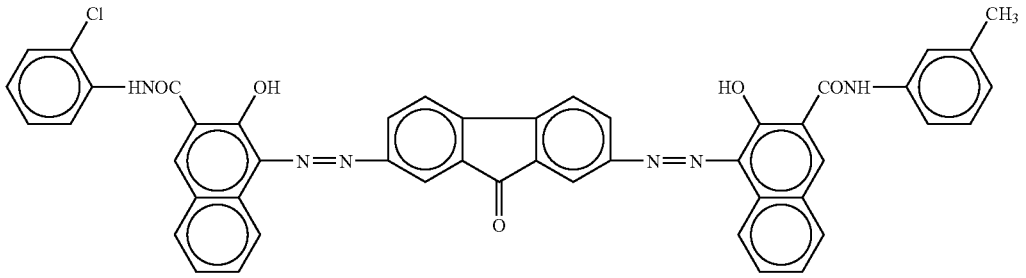

-continued

| | |
|---|---|
| Polyvinyl butyral resin (XYHL, manufactured by Union Carbide Corp.) | 0.25 |
| Cyclohexanone | 200 |
| Methyl ethyl ketone | 80 |

The CGL coating liquid was coated on the undercoat layer and then dried to prepare a CGL having a thickness of 0.2 μm.

Formation of CTL Including No Inorganic Filler (i.e., First CTL)

The following components were mixed to prepare a first CTL coating liquid.

| | |
|---|---|
| Z-form polycarbonate (viscosity average molecular weight of 50,000 manufactured by Teijin Chemicals Ltd.) | 12 |
| CTM having the following formula (B) | 10 |

(B)

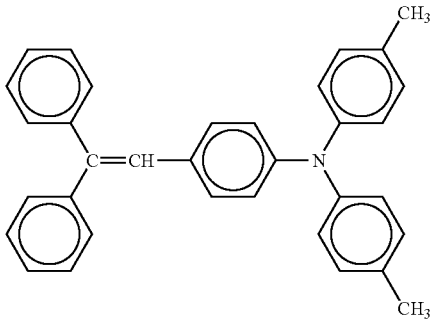

| | |
|---|---|
| | 100 |
| 1% tetrahydrofuran solution of silicone oil (silicone oil: KF50-100CS from Shin-Etsu Chemical Co., Ltd.) | 1 |

The first CTL coating liquid was coated on the CGL and then dried to prepare a first CTL including no inorganic filler and having a thickness of 30 μm.

Formation of Filler-Reinforced CTL Including Inorganic Filler (i.e., Second CTL)

The following components were mixed and dispersed for 24 hours using a ball mill including alumina balls to prepare a second CTL coating liquid including an inorganic filler.

| | |
|---|---|
| Z-form polycarbonate (viscosity average molecular weight of 50,000 manufactured by Teijin Chemicals Ltd.) | 4 |
| CTM having formula (B) | 3 |
| α-alumina (SUMICORUNDUM AA-03 from Sumitomo Chemical Co., Ltd.) | 0.7 |
| Cyclohexanone | 80 |
| Tetrahydrofuran | 280 |

The second CTL coating liquid was coated on the first CTL by a spray coating method and then dried to prepare a second CTL (i.e., a filler-reinforced CTL) having a thickness of 1.5 μm.

Thus a photoreceptor of Example 1 was prepared.

Comparative Example 1

The procedure for preparation of the photoreceptor in Example 1 was repeated except that the second CTL was not formed.

Thus, a photoreceptor of Comparative Example 1 was prepared.

Comparative Example 2

The procedure for preparation of the photoreceptor in Example 1 was repeated except that the second CTL was replaced with the following protective layer.

Formation of Protective Layer

The following components were mixed and dispersed for 24 hours using a ball mill including alumina balls to prepare a protective layer coating liquid.

| | |
|---|---|
| Z-form polycarbonate (viscosity average molecular weight of 50,000 manufactured by Teijin Chemicals Ltd.) | 7 |
| α-alumina (SUMICORUNDUM AA-03 from Sumitomo Chemical Co., Ltd.) | 0.7 |
| Cyclohexanone | 86 |
| Tetrahydrofuran | 300 |

The protective layer coating liquid was coated on the first CTL and then dried to form a protective layer having a thickness of 1.5 μm.

Thus a photoreceptor of Comparative Example 2 was prepared.

Comparative Example 3

The procedure for preparation of the photoreceptor in Example 1 was repeated except that the second CTL was not formed and the first CTL was replaced with the following CTL.

Formation of CTL

The following components were mixed and dispersed for 24 hours using a ball mill including alumina balls to prepare a CTL coating liquid.

| | |
|---|---|
| Z-form polycarbonate (viscosity average molecular weight of 50,000 manufactured by Teijin Chemicals Ltd.) | 11 |
| CTM having formula (B) | 10 |
| α-alumina | 2 |

-continued

| | |
|---|---|
| (SUMICORUNDUM AA-03 from Sumitomo Chemical Co., Ltd.) | |
| Tetrahydrofuran | 100 |
| 1% tetrahydrofuran solution of silicone oil (silicone oil: KF50-100CS from Shin-Etsu Chemical Co., Ltd.) | 1 |

The CTL coating liquid was coated on the CGL and then dried to form a CTL having a thickness of 30 μm.

Thus a photoreceptor of Comparative Example 3 was prepared.

Comparative Example 4

The procedure for preparation of the photoreceptor in Example 1 was repeated except that the Z-form polycarbonate was replaced with an A-form polycarbonate (C1400, manufactured by 25. Teijin Chemicals Ltd.).

Thus a photoreceptor of Comparative Example 4 was prepared.

Each of the photoreceptors of Example 1 and Comparative Examples 1 to 4 was set in a process cartridge for a partially modified version of a copier (IMAGIO MF2200 manufactured by Ricoh Co., Ltd.), and 50,000 images were continuously produced. The environmental conditions were 25° C. 50% RH.

The process cartridge is one supplied to the copier, and includes a photoreceptor, a charger (a contact charging roller), an image developer and a cleaner.

The abrasion amount of the photosensitive layer of each photoreceptor was measured. In addition, the image qualities of the initial images and the final images produced by each photoreceptor were visually evaluated. Further, the water vapor permeability of the outermost layer of each photoreceptor was measured.

The results are shown in Table 1.

TABLE 1

| | Abrasion amount checked after 50,000-sheet running test (μm) | Water vapor permeability ($g \cdot m^{-2} \cdot 24\ h^{-1}$) | Image qualities (initial) | Image qualities after 50,000-sheet running test |
|---|---|---|---|---|
| Ex. 1 | 4.2 | 31.0 | Good | Good |
| Comp. Ex. 1 | 7.3 | 32.0 | Good | Fogging |
| Comp. Ex. 2 | 0.3 | 31.5 | Good | Tailing |
| Comp. Ex. 3 | 1.0 | 30.0 | Low image density | Low image density |
| Comp. Ex. 4 | 4.6 | 51.0 | Good | Fogging, background development |

As can be understood from Table 1, the photoreceptor of Example 1 which includes an inorganic filler (α-alumina) in its photosensitive layer, wherein the filler content at the surface side of the photosensitive layer is greater than that of the bottom side thereof, can produce images having good contrast without producing fogging even after the 50,000 sheet running test. Therefore, it can be said that the photoreceptor has good durability.

In contrast, the photoreceptor of Comparative Example 2 produced images having tailing, and therefore it can be said that the durability of the photoreceptor is inferior to that of the photoreceptor of Example 1.

The photoreceptor of Comparative Example 3 produced low density images from the start of the running test, and therefore it can be said that the photoreceptor cannot be practically used.

Therefore it is very important to increase the filler content at the surface side.

As can be understood by comparing the photoreceptor of Example 1 with the photoreceptor of Comparative Example 4, the photoreceptor having an outermost layer having low water vapor permeability has an insufficient durability. Namely, it is preferable that the outermost layer has a water vapor permeability not greater than 50 $g \cdot m^{-2} \cdot 24\ hr^{-1}$.

Example 2

The procedure for preparation of the photoreceptor in Example 1 was repeated except that the thickness of the first CTL was changed to 26.5 μm.

Thus a photoreceptor of Example 2 was prepared.

Example 3

The procedure for preparation of the photoreceptor in Example 1 was repeated except that the thickness of the first CTL was changed to 22.0 μm.

Thus a photoreceptor of Example 3 was prepared.

The procedure for evaluation of the photoreceptor in Example 1 was repeated except that environmental conditions were changed to 23° C. 67% RH and resolution of the images produced by the photoreceptors of Examples 1 to 3 was mainly evaluated.

The results are shown in Table 2.

TABLE 2

| | Total thickness of CTLs (μm) | Water vapor permeability ($g \cdot m^{-2} \cdot 24\ h^{-1}$) | Background development | Resolution of images after 50,000-sheet running test |
|---|---|---|---|---|
| Ex. 2 | 23.5 | 40.0 | Good | Excellent*1 |
| Ex. 3 | 28.0 | 35.3 | Good | Excellent*1 |
| Ex. 1 | 31.5 | 31.0 | Good | Good*2 |

*1Fine line images having a width of 200 μm and 150 μm could be clearly reproduced.

*2Fine line images having a width of 200 μm could be clearly reproduced. However, line images having a width of 150 μm slightly widened.

As can be understood from Table 2, when the total thickness of the CTLs is not greater than 28 μm, the photoreceptor can produce images having excellent resolution even after the 50,000-sheet running test.

Example 4

The procedure for preparation of the photoreceptor in Example 1 was repeated except that the filler-reinforced CTL coating liquid was replaced with the following.

| Formulation of filler-reinforced CTL liquid | |
|---|---|
| Z-form polycarbonate (viscosity average molecular weight of 50,000 manufactured by Teijin Chemicals Ltd.) | 4 |
| CTM having formula (B) | 3 |
| α-alumina (SUMICORUNDUM AA-03 from Sumitomo Chemical Co., Ltd.) | 2 |
| Cyclohexanone | 80 |
| Tetrahydrofuran | 280 |

Thus, a photoreceptor of Example 4 was prepared.

Example 5

The procedure for preparation of the photoreceptor in Example 1 was repeated except that the filler-reinforced CTL coating liquid was replaced with the following.

| Formulation of filler-reinforced CTL liquid | |
|---|---|
| Z-form polycarbonate (viscosity average molecular weight of 50,000 manufactured by Teijin Chemicals Ltd.) | 4 |
| CTM having formula (B) | 3 |
| α-alumina (SUMICORUNDUM AA-03 from Sumitomo Chemical Co., Ltd.) | 3 |
| Cyclohexanone | 80 |
| Tetrahydrofuran | 280 |

Thus, a photoreceptor of Example 5 was prepared.

Each of the photoreceptors of Examples 1, 4 and 5 was evaluated in the same way as performed in Example 1 except that the 100,000 copies were produced.

The results are shown in Table 3.

TABLE 3

| | Abrasion amount checked after 100,000-sheet running test (μm) | Water vapor permeability ($g \cdot m^{-2} \cdot 24\ h^{-1}$) | Image qualities (initial) | Image qualities after 100,000-sheet running test |
|---|---|---|---|---|
| Ex. 4 | 5.6 | 30.6 | Good | Good |
| Ex. 5 | 1.4 | 30.2 | Good | Good |
| Ex. 1 | 8.6 | 31.0 | Good | Fogging |

As can be understood from Table 3, the photoreceptor of Example 4 can produce images having good contrast without producing fogging even after the 100,000-sheet running test. Namely, it can be said that the photoreceptor has excellent durability.

Further, the photoreceptor of Example 5 can produce images having good contrast without producing fogging even after the 100,000-sheet running test. In addition, the abrasion amount is as little as 1.4 μm even after the 100,000-sheet running test. Therefore it can be said that the photoreceptor has more excellent durability.

Namely, by increasing the filler content in the filler-reinforced CTL, the durability of the photoreceptor can be further improved.

However, by merely increasing the filler content in the filler-reinforced CTL, a problem in that the potential of the lighted portion of the photoreceptor seriously increases occurs. Therefore such a photoreceptor cannot be practically used. In the present invention, the CTL has good gas barrier property in addition to good abrasion resistance, and thereby the life of the photoreceptor can be prolonged.

Example 6

The procedure for preparation of the photoreceptor in Example 1 was repeated except that the thickness of the filler-reinforced CTL was changed to 2 μm.

Thus a photoreceptor of Example 6 was prepared.

The photoreceptors of Examples 1 and 6 were evaluated in the same way as performed on Examples 4 and 5. The results are shown in Table 4.

TABLE 4

| | Abrasion amount checked after 100,000-sheet running test (μm) | Water vapor permeability ($g \cdot m^{-2} \cdot 24\ h^{-1}$) | Image qualities (initial) | Image qualities after 100,000-sheet running test |
|---|---|---|---|---|
| Ex. 6 | 5.4 | 30.6 | Good | Good |
| Ex. 1 | 8.6 | 31.0 | Good | Fogging |

As can be understood from Table 4, the photoreceptor of Example 6 can produce images having good contrast without producing fogging even after the 100,000-sheet running test. Namely, it can be said that the photoreceptor of Example 6 has excellent durability. This is because the abrasion resistance of the filler-reinforced CTL of the photoreceptor of the present invention is much better than that of conventional photoreceptors.

Example 7

The procedure for preparation of the photoreceptor in Example 1 was repeated except that the formulation of the first and second CTL coating liquids were changed as follows.

| Formulation of first CTL coating liquid including no filler | |
|---|---|
| A-form polycarbonate (C1400, manufactured by Teijin Chemicals Ltd.) | 8 |
| CTM having formula (B) | 10 |
| Phenolic antioxidant (SUMILIZER BP76 manufactured by Sumitomo Chemical Co., Ltd.) | 4 |
| Tetrahydrofuran | 100 |
| 1% tetrahydrofuran solution of a silicone oil (Silicone oil: KF50-100CS from Shin-Etsu Chemical Co., Ltd.) | 1 |

-continued

| Formulation of second CTL coating liquid (filler-reinforced CTL coating liquid) | |
|---|---|
| A-form polycarbonate (C1400, manufactured by Teijin Chemicals Ltd.) | 4 |
| CTM having formula (B) | 3 |
| α-alumina (SUMICORUNDUM AA-03 from Sumitomo Chemical Co., Ltd.) | 0.7 |
| Cyclohexanone | 80 |
| Tetrahydrofuran | 280 |

Thus, a photoreceptor of Example 7 was prepared.

Example 8

The procedure for preparation of the photoreceptor in Example 7 was repeated except that the antioxidant was replaced with a plasticizer, dioctyl sebacate (manufactured by Tokyo Kasei Kogyo Co., Ltd.).

Thus a photoreceptor of Example 8 was prepared.

Example 9

The procedure for preparation of the photoreceptor in Example 7 was repeated except that the antioxidant was replaced with a lubricant, butyl stearate (manufactured by Tokyo Kasei Kogyo Co., Ltd.).

Thus a photoreceptor of Example 9 was prepared.

Example 10

The procedure for preparation of the photoreceptor in Example 7 was repeated except that the antioxidant was replaced with an ultraviolet absorbent, bis(1,2,2,6,6-pentamethyl-4-piperidyl) sebacate (SANOL LS-765, manufactured by Sankyo Co., Ltd.).

Thus a photoreceptor of Example 10 was prepared.

Example 11

The procedure for preparation of the photoreceptor in Example 7 was repeated except that the antioxidant was replaced with a low molecular weight CTM having the following formula:

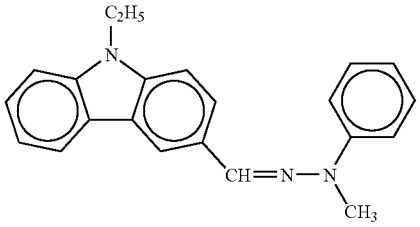

Thus a photoreceptor of Example 11 was prepared.

Example 12

The procedure for preparation of the photoreceptor in Example 7 was repeated except that the antioxidant was replaced with an electrically inactive polymer having a weight average molecular weight of 110,000 and having the following formula:

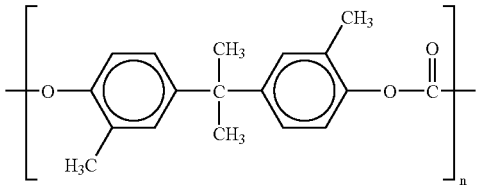

Thus a photoreceptor of Example 12 was prepared.

The photoreceptors of Examples 7 to 12 and Comparative Example 4 were evaluated in the same way as performed on Example 1. The results are shown in Table 5.

As can be understood from Table 5, by adding a low molecular weight compound such as antioxidants, plasticizers, lubricants, ultraviolet absorbents and low molecular weight CTMs in a CTL having a water vapor permeability greater than 50.0 $g \cdot m^{-2} \cdot 24\ h^{-1}$, the water vapor permeability can be decreased so as to be not greater than 50.0 $g \cdot m^{-2} \cdot 24\ h^{-1}$.

As can be understood from Example 12, by replacing the antioxidant with a polymer having low water vapor permeability (the polymer film having a thickness of 30 μm has a water vapor permeability of 32 $g \cdot m^{-2} \cdot 24\ h^{-1}$), the gas permeability of the resultant photoreceptor can be decreased.

A film of the binder resin C1400 used in the CTL of the photoreceptor of Comparative Example 4, which has a thickness of 30 μm, has a water vapor permeability of 140.0 $g \cdot m^{-2} \cdot 24\ h^{-1}$. Therefore it is found that by adding a resin component having a water vapor permeability lower than that of C1400, the water vapor permeability of the resultant CTL can be decreased.

As can be understood from Table 5, the photoreceptors of Examples 7 to 12 have good gas barrier property because a low molecular weight compound is added. In addition, the photoreceptors of Examples 7 to 12 can produce images without undesired images such as background development.

In conventional photoreceptors, if a large amount of such a low molecular weight compound is added to the photosensitive layer, the layer becomes seriously brittle. Therefore such a compound is added in only a small amount. However, in the photoreceptor of the present invention, since a functional layer having a good abrasion resistance function is formed on the lower layer, a large amount of such a low molecular weight compound can be added to the lower layer. Namely it can be said that the photoreceptors of Examples 7 to 12 have good designing flexibility.

TABLE 5

| | Abrasion amount checked after 50,000-sheet running test (μm) | Water vapor permeability ($g \cdot m^{-2} \cdot 24\ h^{-1}$) | Image qualities (initial) | Image qualities after 50,000-sheet running test |
|---|---|---|---|---|
| Ex. 7 | 4.7 | 25.3 | Good | Good |
| Ex. 8 | 4.6 | 24.9 | Good | Good |
| Ex. 9 | 4.6 | 27.3 | Good | Good |
| Ex. 10 | 4.5 | 29.8 | Good | Good |
| Ex. 11 | 4.6 | 28.6 | Good | Good |
| Ex. 12 | 4.6 | 40.8 | Good | Good |
| Comp. Ex. 4 | 4.6 | 51.0 | Good | Fogging, background development |

Example 13

The procedure for preparation of the aluminum drum having an undercoat layer in Example 1 was repeated.

| Formation of mixture type photosensitive layer having no filler (i.e., first mixture type photosensitive layer) | |
|---|---|
| Z-form polycarbonate (viscosity average molecular weight of 50,000 manufactured by Teijin Chemicals Ltd.) | 10 |
| Metal-free phthalocyanine (manufactured by Ricoh Co., Ltd.) | 0.2 |
| CTM having formula (B) | 6 |
| CTM having the following formula (C) | 4 |
| (C) 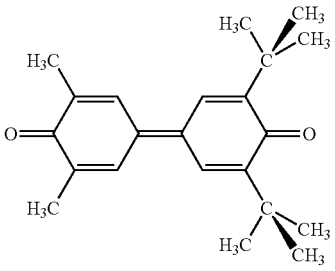 | |
| Tetrahydrofuran | 100 |
| 1% tetrahydrofuran solution of silicone oil (silicone oil: KF50-100CS from Shin-Etsu Chemical Co., Ltd.) | 1 |

The following components were mixed to prepare a first CTL coating liquid (i.e., a mixture type photosensitive layer having no filler).

The first mixture type photosensitive layer coating liquid was coated on the undercoat layer and then dried to prepare a first photosensitive layer including no inorganic filler and having a thickness of 30 μm.

Formation of Filler-Reinforced Mixture Type Photosensitive Layer (i.e., Second Mixture Type Photosensitive Layer)

The following components were mixed and dispersed for 24 hours using a ball mill including alumina balls to prepare a second photosensitive layer coating liquid including an inorganic filler.

| | |
|---|---|
| Z-form polycarbonate (viscosity average molecular weight of 50,000 manufactured by Teijin Chemicals Ltd.) | 9 |
| Metal-free phthalocyanine (manufactured by Ricoh Co., Ltd.) | 0.2 |
| CTM having formula (B) | 5.4 |
| CTM having formula (C) | 3.6 |
| α-alumina (SUMICORUNDUM AA-03 from Sumitomo Chemical Co., Ltd.) | 2 |
| Cyclohexanone | 80 |
| Tetrahydrofuran | 280 |

The second mixture type photosensitive layer coating liquid was coated on the first photosensitive layer by a spray coating method and then dried to prepare a second mixture type photosensitive layer (i.e., a filler-reinforced CTL) having a thickness of 1.5 μm.

Thus a photoreceptor of Example 13 was prepared.

Comparative Example 5

The procedure for preparation of the photoreceptor in Example 13 was repeated except that the second mixture type photosensitive layer (i.e., the filler-reinforced mixture type photoreceptor) was not formed.

Thus a photoreceptor of Comparative Example 5 was prepared.

Comparative Example 6

The procedure for preparation of the photoreceptor in Example 13 was repeated except that the second mixture type photosensitive layer was replaced with the following protective layer.

Formation of Protective Layer

The following components were mixed and dispersed for 24 hours using a ball mill including alumina balls to prepare a protective layer coating liquid.

| | |
|---|---|
| Z-form polycarbonate (viscosity average molecular weight of 50,000 manufactured by Teijin Chemicals Ltd.) | 18.2 |
| α-alumina (SUMICORUNDUM AA-03 from Sumitomo Chemical Co., Ltd.) | 2 |
| Cyclohexanone | 80 |
| Tetrahydrofuran | 280 |

The protective layer coating liquid was coated on the first photosensitive layer and then dried to form a protective layer having a thickness of 1.5 μm.

Thus a photoreceptor of Comparative Example 6 was prepared.

Comparative Example 7

The procedure for preparation of the photoreceptor in Example 13 was repeated except that the first and second photosensitive layers was not formed and the second mixture type photosensitive layer was replaced with the following mixture type photosensitive layer including a filler.

Formation of Mixture Type Photosensitive Layer

The following components were mixed and dispersed for 24 hours using a ball mill including alumina balls to prepare a CTL coating liquid.

| | |
|---|---|
| Z-form polycarbonate (viscosity average molecular weight of 50,000 manufactured by Teijin Chemicals Ltd.) | 10 |
| Metal-free phthalocyanine (manufactured by Ricoh Co., Ltd.) | 0.2 |
| CTM having formula (B) | 5.4 |
| CTM having formula (C) (manufactured by Ricoh Co., Ltd.) | 3.6 |
| α-alumina (SUMICORUNDUM AA-03 from Sumitomo Chemical Co., Ltd.) | 2 |
| Tetrahydrofuran | 100 |
| 1% tetrahydrofuran solution of silicone oil | 1 |

-continued

| | |
|---|---|
| (silicone oil: KF50-100CS from Shin-Etsu Chemical Co., Ltd.) | |

The photosensitive layer coating liquid was coated on the undercoat layer and then dried to form a mixture type photosensitive layer having a thickness of 30 μm.

Thus a photoreceptor of Comparative Example 7 was prepared.

Each of the photoreceptors of Example 13 and Comparative Examples 5 to 7 was evaluated in the same way as performed in Example 1 (50,000-sheet running test). The results are shown in Table 6.

TABLE 6

| | Abrasion amount checked after 50,000-sheet running test (μm) | Water vapor permeability ($g \cdot m^{-2} \cdot 24\ h^{-1}$) | Image qualities (initial) | Image qualities after 50,000-sheet running test |
|---|---|---|---|---|
| Ex. 13 | 4.9 | 21.5 | Good | good |
| Comp. Ex. 5 | 8.1 | 23.0 | Good | fogging |
| Comp. Ex. 6 | 2.3 | 20.0 | Good | Tailing |
| Comp. Ex. 7 | 3.3 | 20.0 | Low image density | Low image density |

As can be understood from Table 6, the photoreceptor of Example 13 which includes α-alumina in its mixture type photosensitive layer and in which the filler content at the surface side of the photosensitive layer is greater than that at the bottom side thereof can produce high contrast images without producing fogging even after the 50,000-sheet running test. Therefor, it can be said that the photoreceptor has good durability.

In contrast, the photoreceptor of Comparative Example 6, which has a protective layer including an inorganic filler and which is one of conventional photoreceptors, produced images having tailing after the 50,000-sheet running test. Therefore it can be said that the durability of the photoreceptor of Comparative Example 6 is inferior to that of the photoreceptor of Example 13. Similarly, the photoreceptor of Comparative Example 7, which has a photosensitive layer in which a filler is uniformly included, has a drawback in that the image density is low from the start of the running test. Therefore it can be said that the photoreceptor is of no practical use.

Therefore, it can be said that it is very important to include a filler in the photosensitive layer such that the filler content at the surface side is greater than that at the bottom side thereof.

Example 14

The procedure for preparation of the photoreceptor in Example 1 was repeated except that the second CTL coating liquid were changed to the following:

| Formulation of the second CTL coating liquid (i.e., filler-reinforced CTL coating liquid | |
|---|---|
| Z-form polycarbonate (viscosity average molecular weight of 50,000 manufactured by Teijin Chemicals Ltd.) | 3.7 |
| CTM having formula (B) | 2.8 |
| α-alumina (SUMICORUNDUM AA-03 from Sumitomo Chemical Co., Ltd.) | 2.5 |
| Cyclohexanone | 80 |
| Tetrahydrofuran | 280 |

Thus a photoreceptor of Example 14 was prepared.

Example 15

The procedure for preparation of the photoreceptor in Example 14 was repeated except that the second CTL coating liquid was changed to the following:

| Formulation of the second CTL coating liquid (i.e., filler-reinforced CTL coating liquid | |
|---|---|
| Z-form polycarbonate (viscosity average molecular weight of 50,000 manufactured by Teijin Chemicals Ltd.) | 3.7 |
| CTM having formula (B) | 2.8 |
| α-alumina (AKP-30 from Sumitomo Chemical Co., Ltd.) | 2.5 |
| Cyclohexanone | 80 |
| Tetrahydrofuran | 280 |

Thus a photoreceptor of Example 15 was prepared.

Example 16

The procedure for preparation of the photoreceptor in Example 14 was repeated except that the second CTL coating liquid was changed to the following:

| Formulation of the second CTL coating liquid (i.e., filler- reinforced CTL coating liquid | |
|---|---|
| Z-form polycarbonate (viscosity average molecular weight of 50,000 manufactured by Teijin Chemicals Ltd.) | 3.7 |
| CTM having formula (B) | 2.8 |
| α-alumina | 2.5 |

-continued

| Formulation of the second CTL coating liquid (i.e., filler- reinforced CTL coating liquid | |
|---|---|
| (AA-07 from Sumitomo Chemical Co., Ltd.) | |
| Cyclohexanone | 80 |
| Tetrahydrofuran | 280 |

Thus a photoreceptor of Example 16 was prepared.

Each of the photoreceptors of Examples 14 to 16 was evaluated in the same way as performed in Example 1 except that 150,000 images were formed in the running test. In addition, the average particle diameter and the ratios of D/H and Db/Da of the α-alumina were also measured.

The results are shown in Table 7.

TABLE 7

| | Water vapor permeability ($g \cdot m^{-2} \cdot 24\ h^{-1}$) | Average particle diameter (μm) | D/H | Db/Da | Image qualities after the running test |
|---|---|---|---|---|---|
| Ex. 14 | 31.0 | 0.4 | 1.0 | 4.8 | good |
| Ex. 15 | 33.2 | 0.4 | 3.2 | 5.1 | Fine white streaks |
| Ex. 16 | 31.5 | 0.7 | 1.0 | 3.6 | Fine white streaks |

As can be understood from Table 7, the photoreceptors of Examples 14 to 16 can produce images having good contrast and sharpness even after the 150,000-sheet running test. Namely, it can be said that the photoreceptors have excellent durability.

The images produced by the photoreceptors of Examples 15 and 16 are slightly uneven when observed microscopically. This is because the filler (AKP-30) used in Example 15 is inferior to the filler (AA-04) in view of the close-packing ability, and the average particle diameter of the filler (AA-07) used in Example 16 is larger than that of the filler (AA-04) and therefore the filler projects its tops from the surface of the outermost layer.

Thus, image qualities are influenced by the surface conditions of the photoreceptor used.

Example 17

The procedure for preparation of the photoreceptor in Example 1 was repeated except that the formulation of the filler-reinforced CTL coating liquid (i.e., the second CTL coating liquid) was changed to the following:

| Formulation of filler-reinforced CTL coating liquid | |
|---|---|
| Z-form polycarbonate (viscosity average molecular weight of 50,000 manufactured by Teijin Chemicals Ltd.) | 3.5 |
| CTM having formula (B) | 2.45 |
| α-alumina (AA-04 from Sumitomo Chemical Co., Ltd.) | 1.5 |
| Cyclohexanone | 80 |
| Tetrahydrofuran | 280 |

Thus a photoreceptor of Example 17 was prepared.

Example 18

The procedure for preparation of the photoreceptor in Example 17 was repeated except that the CTM in the filler-reinforced CTL coating liquid was replaced with a compound having the following formula (D):

(D)

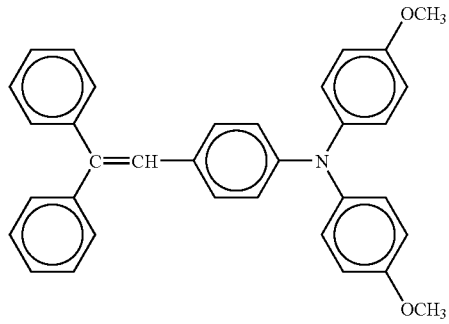

Thus a photoreceptor of Example 18 was prepared.

Example 19

The procedure for preparation of the photoreceptor in Example 17 was repeated except that the CTM in the filler-reinforced CTL coating liquid was replaced with a compound having the following formula (E):

(E)

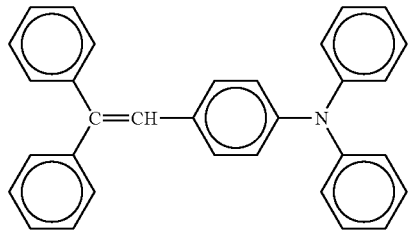

Thus a photoreceptor of Example 19 was prepared.

Each of the photoreceptors of Examples 17 to 19 was evaluated in the same way as performed in Example 1 except that the environmental conditions were changed to 27° C. 62% RH. In addition, the ionization potential of each CTM in the filler-reinforced CTL and the potential of a lighted portion of each photoreceptor were also measured after the 50,000-sheet running test.

The results are shown in Table 8.

TABLE 8

| | Water vapor permeability ($g \cdot m^{-2} \cdot 24\ h^{-1}$) | Ionization potential of CTM (eV) | Potential of lighted portion (−V) | Image qualities after running test |
|---|---|---|---|---|
| Ex. 17 | 31.1 | 5.45 | 60 | Good |
| Ex. 18 | 30.6 | 5.31 | 110 | Good |
| Ex. 19 | 31.6 | 5.56 | 60 | Good |

Since the ionization potential of the CTM included in the first CTL of the photoreceptors of Examples 17 to 19 is 5.48 eV, the difference in ionization potential between the CTM in the second CTL and the CTM in the first CTL is 0.03, 0.17 and 0.08 in Examples 17, 18 and 19, respectively.

As can be understood from Table 8, the lighted portion of the photoreceptor of Example 18 has a potential greater than that of the photoreceptors of Examples 17 and 19 because the ionization potential difference of the photoreceptor of Example 18 is relatively large compared to those of the photoreceptors of Examples 17 and 19. Namely, it is found that by using CTMs having similar ionization potentials in the photosensitive layer, the resultant photoreceptor has good charge properties.

Example 20

The procedure for preparation of the photoreceptor in Example 17 was repeated except that the first CTL layer coating liquid was changed to the following:

| Formulation of first CTL coating liquid | |
|---|---|
| Charge transport polymer having a weight average molecular weight of 102,000 and having the following formula (F): | 12 |

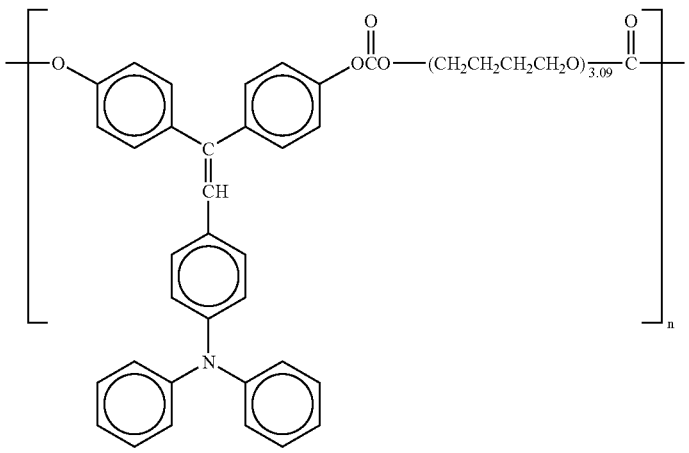

| | |
|---|---|
| CTM having formula (E) | 3 |
| Tetrahydrofuran | 100 |
| 1% tetrahydrofuran solution of a silicone oil (silicone oil: KF50-100CS from Shin-Etsu Chemical Co., Ltd.) | 1 |

Thus, a photoreceptor of Example 20 was prepared.

Example 21

The procedure for preparation of the photoreceptor in Example 17 was repeated except that 2.45 parts of the CTM in the second CTL coating liquid was replaced with 3 parts of a CTM having formula (D).

Thus, a photoreceptor of Example 21 was prepared.

Example 22

The procedure for preparation of the photoreceptor in Example 17 was repeated except that the first CTL layer coating liquid was changed to the following:

| Formulation of first CTL coating liquid | |
|---|---|
| Charge transport polymer having a weight average molecular weight of 102,000 and having formula (F): | 15 |
| Tetrahydrofuran | 100 |
| 1% tetrahydrofuran solution of a silicone oil (silicone oil: KF50-100CS from Shin-Etsu Chemical Co., Ltd.) | 1 |

Thus, a photoreceptor of Example 22 was prepared.

The photoreceptors of Examples 20 to 22 were evaluated in the same way as performed in Examples 17 to 19 except that the environmental conditions were 26° C. 53% RH.

The results are shown in Table 9.

TABLE 9

| | Water vapor permeability ($g \cdot m^{-2} \cdot 24\ h^{-1}$) | Ionization potential of CTMs (eV) | Potential of lighted portion (−V) | Image qualities after running test |
|---|---|---|---|---|
| Ex. 20 | 38.3 | 5.48(CTM (F))<br>5.56(CTM (E)) | 55 | Good |
| Ex. 21 | 36.9 | 5.48(CTM (F))<br>5.31(CTM (D)) | 100 | Good |
| Ex. 22 | 48.8 | 5.48(CTM (F)) | 60 | Good |

As can be understood from Table 9, the photoreceptor of Example 20, in which the ionization potential difference between the two CTMs included in the CTL is as little as 0.08 eV, has a relatively low potential of a lighted portion compared to that of the photoreceptor of Example 22 which includes only the charge transport polymer having formula (F).

In contrast, in the photoreceptor of Example 21, the ionization potential difference between the two CTMs included in the CTL is 0.17 eV, which is relatively large compared to that of the photoreceptor of Example 20, the potential of the lighted portion is relatively high compared to that of the photoreceptor of Example 20.

Example 23

The procedure for preparation of the photoreceptor in Example 1 was repeated except that the first and second CTL coating liquids were changed to the coating liquids mentioned below and the thickness of the first and second CTLs was changed to 22 μm and 2.5 μm, respectively.

| Formulation of the first CTL coating liquid | |
|---|---|
| Z-form polycarbonate (viscosity average molecular weight of 50,000 manufactured by Teijin Chemicals Ltd.) | 10 |
| CTM having formula (B) | 7 |
| Tetrahydrofuran | 100 |
| 1% tetrahydrofuran, solution of a silicone oil (silicone oil: KF50-100CS from Shin-Etsu Chemical Co., Ltd.) | 1 |

| Formulation of the second CTL coating liquid | |
|---|---|
| Z-form polycarbonate (viscosity average molecular weight of 50,000 manufactured by Teijin Chemicals Ltd.) | 3.5 |
| CTM having formula (E) | 2.45 |
| α-alumina (SUMICORUNDUM AA-05 from Sumitomo Chemical Co., Ltd.) | 1.5 |
| Cyclohexanone | 80 |

-continued

| Formulation of the second CTL coating liquid | |
|---|---|
| Tetrahydrofuran | 280 |

Thus a photoreceptor of Example 23 was prepared.

Example 24

The procedure for preparation of the photoreceptor in Example 23 was repeated except that 7 parts of the CTM (B) in the second CTL coating liquid was replaced with 9 parts of the CTM having formula (E).

Thus, a photoreceptor of Example 24 was prepared.

Example 25

The procedure for preparation of the photoreceptor in Example 23 was repeated except that the first CTL layer coating liquid was changed to the following:

| Formulation of first CTL coating liquid | |
|---|---|
| Charge transport polymer having a weight average molecular weight of 102,000 and having formula (F): | 15 |
| Tetrahydrofuran | 100 |
| 1% tetrahydrofuran solution of a silicone oil (silicone oil: KF50-100CS from Shin-Etsu Chemical Co., Ltd.) | 1 |

Thus, a photoreceptor of Example 25 was prepared.

Example 26

The procedure for preparation of the photoreceptor in Example 23 was repeated except that the CTM (B) in the first CTL coating liquid was replaced with a low molecular weight CTM having the following formula (G):

(G)

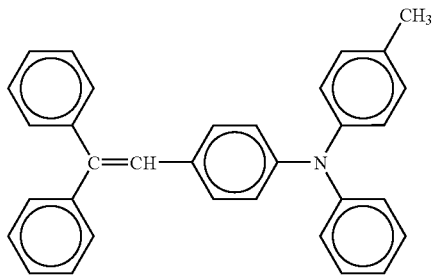

Thus, a photoreceptor of Example 26 was prepared.

The photoreceptors of Examples 23 to 26 were evaluated in the same way as performed on the photoreceptor in Example 1 was repeated except that the charge mobility of the first CTL and the dependency β of the charge mobility on the electric field were also evaluated.

The results are shown in Table 10.

TABLE 10

| | Water vapor permeability ($g \cdot m^{-2} \cdot 24\ h^{-1}$) | Charge mobility × $10^{-5}\ cm^2/V \cdot sec$ | $\beta \times 10^{-3}$ | Resolution of images after 50,000-sheet running test |
|---|---|---|---|---|
| Ex. 23 | 32.9 | 1.6 | 1.1 | excellent*1 |
| Ex. 24 | 31.3 | 1.5 | 1.0 | excellent*1 |
| Ex. 25 | 48.7 | 2.9 | 1.4 | excellent*1 |
| Ex. 26 | 34.4 | 0.36 | 1.0 | Good*2 |

*1Fine line images having a width of 80 μm and 100 μm could be clearly reproduced.
*2Fine line images having a width of 100 μm could be clearly reproduced. However, line images having a width of 80 μ slightly widened.

As can be understood from Table 10, the first CTLs of the photoreceptors of Examples 23 to 25 have a relatively high charge mobility compared to that of the photoreceptor of Example 26, and therefore the photoreceptors can produce images having good resolution.

These photoreceptors have high speed response and therefore can be preferably used for high speed image forming apparatus and/or image forming apparatus having a small size photoreceptor.

Further, the photoreceptors, which have small dependency β, have low residual potential and in addition the response thereof is hardly deteriorated even when the charge potential is decreased. Therefore, the photoreceptors can be preferably used for energy-saving image forming apparatus.

Example 27

The procedure for preparation of the photoreceptor in Example 23 was repeated except that the thickness of the first and second CTLs was changed to 20 μm and 4.5 μm, respectively and the CGL coating liquid, and the first and second CTL coating liquids was changed to the following:

| Formulation of the first CTL coating liquid. | |
|---|---|
| Z-form polycarbonate (viscosity average molecular weight of 40,000 manufactured by Teijin Chemicals Ltd.) | 10 |
| CTM having formula (B) | 7 |
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Z-form polycarbonate (viscosity average molecular weight of 50,000 manufactured by Teijin Chemicals Ltd.) | 3.5 |
| CTM having formula (B) | 2.45 |
| α-alumina (SUMICORUNDUM AA-05 from Sumitomo Chemical Co., Ltd.) | 1.5 |
| Resistivity decreasing agent (BYK-P104 manufactured by BYK Chemie) | 0.03 |
| Cyclohexanone | 80 |
| Tetrahydrofuran | 280 |

Thus, a photoreceptor of Example 27 was prepared.

Comparative Example 8

The procedure for preparation of the photoreceptor in Example 27 was repeated except that the first and second CTL layer coating liquids were changed to the following.

| Formulation of the CGL coating liquid | |
|---|---|
| Bisazo pigment having the following formula (H) | 2.5 |

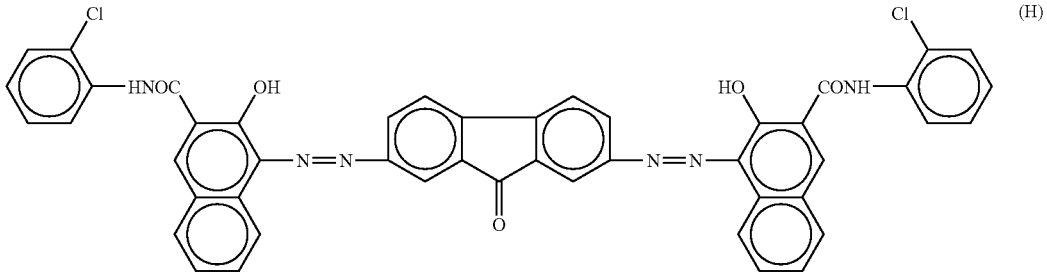

| | |
|---|---|
| Polyvinyl butyral resin (XYHL, manufactured by Union Carbide Corp.) | 0.25 |
| Cyclohexanone | 200 |
| Methyl ethyl ketone | 80 |

| Formulation of the first CTL coating liquid | |
|---|---|
| Charge transport polymer having a weight average molecular weight of 102,000 and having the following formula (J) | 15 |

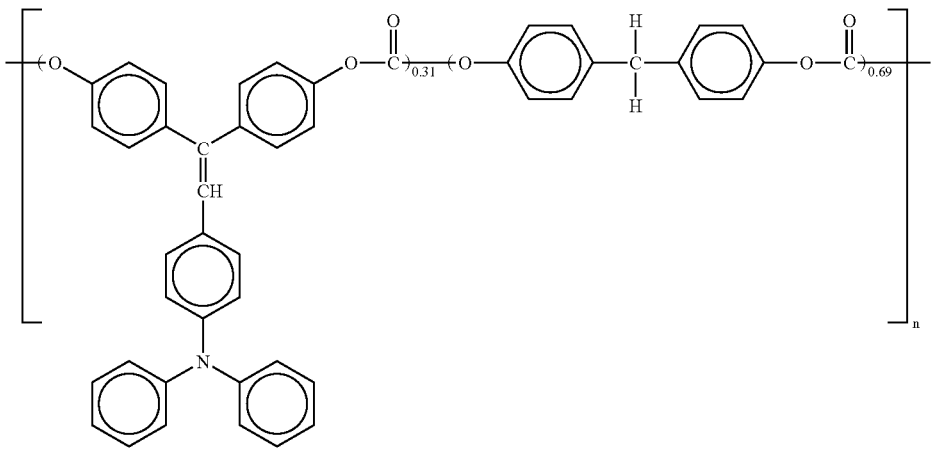

(J)

| | |
|---|---|
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having a weight average molecular weight of 102,000 and having formula (J) | 5.95 |
| α-alumina (SUMICORUNDUM AA-05 from Sumitomo Chemical Co., Ltd.) | 1.5 |
| Resistivity decreasing agent (BYK-P104 manufactured by BYK Chemie) | 0.03 |
| Cyclohexanone | 80 |
| Tetrahydrofuran | 280 |

Thus, a photoreceptor of Comparative Example 8 was prepared.

The photoreceptors of Example 27 and Comparative Example 8 were evaluated in the same way as performed in Example 1 except that the running test was performed under the following conditions:

(1) the number of produced copies: 100,000

(2) environmental conditions: 23° C. 67% RH (3) charger: scorotron charger

The results are shown in Table 11

TABLE 11

| | Water vapor permeability ($g \cdot m^{-2} \cdot 24\ h^{-1}$) | Image qualities after the 100,000-sheet running test |
|---|---|---|
| Ex. 27 | 36.0 | Slight background development. (the images are still acceptable.) |
| Comp. Ex. 8 | 102.3 | Fogging |

As can be understood from Table 11, the images produced by the photoreceptor of Example 27 have slight background development, but the image are still acceptable. However, the images produced by the photoreceptor of Comparative Example 8 have fogging and the image qualities are not acceptable. This is because the photoreceptor of Comparative Example 8 has a large water vapor permeability.

The photoreceptor of the present invention can be used for a long period of time even when used for image forming apparatus using a scorotron charger which produces a large amount of ozone.

Example 28

The procedures for preparation and evaluation of the photoreceptor in Example 27 were repeated except that the scorotron charger was changed to a contact charging roller which applied a DC voltage of −1500 V while contacting the surface of the photoreceptor.

As a result, the first to $50{,}000^{th}$ images were good, however, slight background development was observed in the images after 50,000 images were produced. This background development was caused by contamination of the charging roller with toner (i.e., toner film was formed on the peripheral surface of the charging roller). However, the odor of ozone was much less than in the case in which the scorotron charger was used.

Example 29

The procedures for preparation and evaluation of the photoreceptor in Example 28 were repeated except that an insulating tape having a thickness of 50 μm and a width of 5 mm was adhered to both edges of the charging roller to form a gap of 50 μm between the peripheral surface of the charging roller and the peripheral surface of the photoreceptor (i.e., proximity charging was performed).

As a result, the first to $50{,}000^{th}$ images were good, however, slightly uneven half tone images were observed in the images after 50,000 images were produced. The uneven half tone images were caused by uneven charging of the charging roller.

Example 30

The procedures for preparation and evaluation of the photoreceptor in Example 29 were repeated except that a DC voltage overlapped with an AC voltage was applied to the photoreceptor by the charging roller. The charging conditions were changed as follows:

(1) DC voltage: −850 V (2) AC voltage: 1.7 kV (peak-to-peak voltage) 2 kHz (frequency)

As a result, the uneven half tone images were not observed during the 100,000-sheet running test.

Example 31

The procedure for preparation of the photoreceptor in Example 1 was repeated except that the diameter of the aluminum substrate was changed to 60 mm; the thickness of the first and second CTLs was changed to 20 μm and 4 μm, respectively; and the first and second CTL coating liquids were changed to the following:

| Formulation of the first CTL coating liquid | |
|---|---|
| Z-form polycarbonate (viscosity average molecular weight of 50,000 manufactured by Teijin Chemicals Ltd.) | 10 |
| CTM having formula (B) | 7 |
| Tetrahydrofuran | 100 |
| 1% tetrahydrofuran solution of a silicone oil (silicone oil: KF50-100CS from Shin-Etsu Chemical Co., Ltd.) | 1 |

-continued

| Formulation of the second CTL coating liquid | |
|---|---|
| Z-form polycarbonate (viscosity average molecular weight of 50,000 manufactured by Teijin Chemicals Ltd.) | 7 |
| CTM having formula (B) | 5 |
| α-alumina (SUMICORUNDUM AA-05 from Sumitomo Chemical Co., Ltd.) | 5 |
| Cyclohexanone | 80 |
| Tetrahydrofuran | 280 |

Thus a photoreceptor of Example 31 was prepared.

Example 32

The procedure for preparation of the photoreceptor in Example 31 was repeated except that the first and second CTL coating liquids were changed to the following:

| Formulation of the first CTL coating liquid | |
|---|---|
| Charge transport polymer having a weight average molecular weight of 110,000 and the following formula (K) | 12.7 |

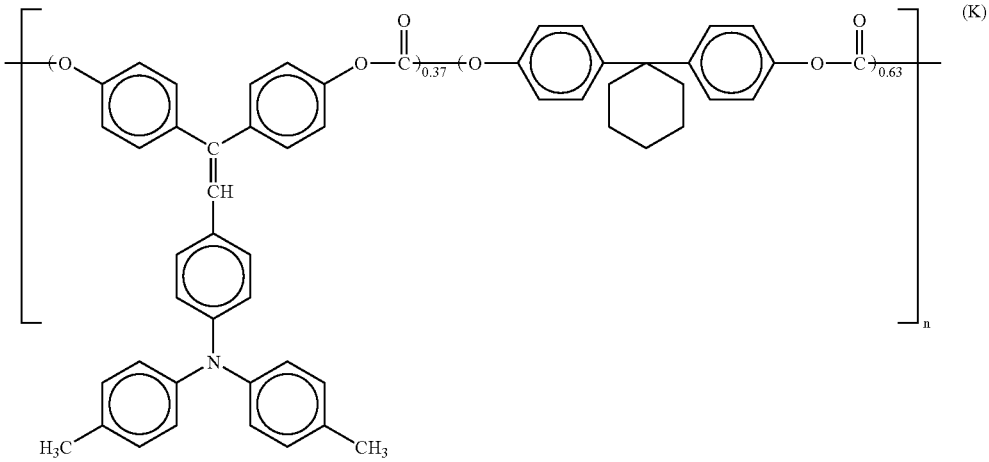

| | |
|---|---|
| Compound having the following formula (L) (plasticizer) | 2.3 |

-continued

| Formulation of the first CTL coating liquid | |
|---|---|
| 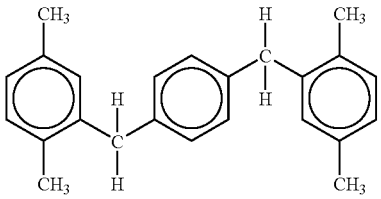 (L) | |
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having a weight average molecular weight of 110,000 and formula (K) | 6.3 |
| Compound having formula (L) | 1.6 |
| α-alumina (Sumicorundum AA-05 from Sumitomo Chemical Co., Ltd.) | 3.5 |
| Cyclohexanone | 80 |
| Tetrahydrofuran | 280 |

Thus a photoreceptor of Example 32 was prepared.

Comparative Example 9

The procedure for preparation of the photoreceptor in Example 31 was repeated except that the first and second CTL coating liquids were changed to the following:

| Formulation of the first CTL coating liquid | |
|---|---|
| Charge transport polymer having a weight average molecular weight of 110,000 and the following formula (M) | 14.3 |
| 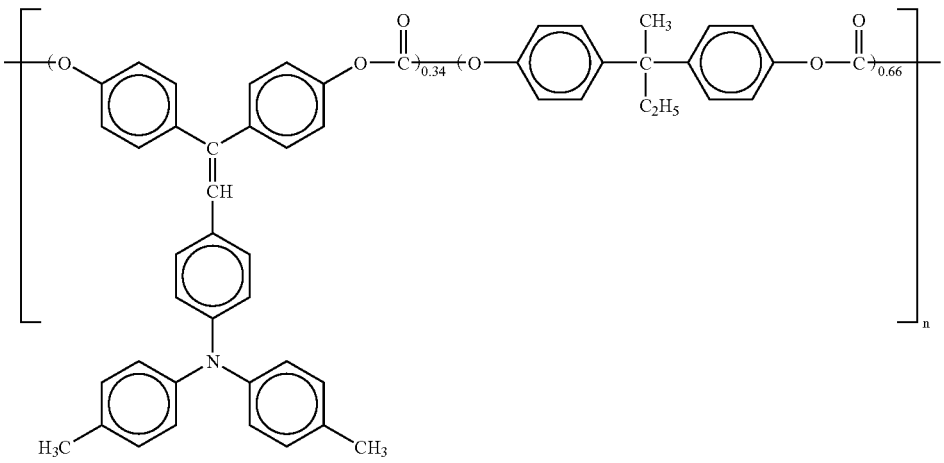 (M) | |
| Compound having formula (L) | 0.7 |
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having a weight average molecular weight of 110,000 and formula (M) | 7.5 |
| Compound having formula (L) | 0.4 |
| α-alumina (SUMICORUNDUM AA-05 from Sumitomo Chemical Co., Ltd.) | 3.5 |
| Cyclohexanone | 80 |
| Tetrahydrofuran | 280 |

Thus a photoreceptor of Comparative Example 9 was prepared.

Comparative Example 10

The procedure for preparation of the photoreceptor in Example 31 was repeated except that the second CTL was not formed, the first CTL coating liquid was replaced with the CTL coating liquid mentioned below and the thickness of the first CTL was changed to 24 μm.

| Formulation of the CTL coating liquid | |
|---|---|
| Z-form polycarbonate resin | 10 |
| CTM having formula (B) | 7 |
| Tetrahydrofuran | 100 |
| 1% tetrahydrofuran solution of a silicone oil (silicone oil: KF50-100CS from Shin-Etsu Chemical Co., Ltd.) | 1 |

Thus, a photoreceptor of Comparative Example 10 was prepared.

Comparative Example 11

The procedure for preparation of the photoreceptor in Example 32 was repeated except that the second CTL was not formed, the first CTL coating liquid was replaced with the CTL coating liquid mentioned below and the thickness of the first CTL was changed to 24 μm.

| Formulation of the CTL coating liquid | |
|---|---|
| Charge transport polymer having formula (M) | 14.3 |
| CTM having formula (L) | 0.7 |
| Tetrahydrofuran | 100 |
| 1% tetrahydrofuran solution of a silicone oil (silicone oil: KF50-100CS from Shin-Etsu Chemical Co., Ltd.) | 1 |

Thus, a photoreceptor of Comparative Example 11 was prepared.

Each of the photoreceptors of Examples 31 and 32 and Comparative Examples 9 to 11 was set in a modified image forming apparatus of IMAGIO NEO 350 manufactured by Ricoh Co., Ltd., and a running test in which 200,000 images were produced was performed. The image forming conditions are as follows:

(1) Charger: a charging roller (2) Voltage applied by the charger: the applied voltage was adjusted such that the initial potential of the photoreceptor was −700 V. The charging condition was not changed during the running test.

(3) Developing bias: −500 V (4) Environmental condition: 24° C. 54% RH

After the running test, the abrasion amount of the photosensitive layer was checked and the images were observed to determine whether a residual image is observed (i.e., an image recorded in a former copy is recorded as a residual image in an image recorded in a latter copy). In addition, the water vapor permeability of the photosensitive layer was measured (when the photosensitive layer is constituted of two layers, the water vapor permeability of the combination layers was measured).

The image quality was graded as follows with respect to the residual image.

Rank 5: residual image is not observed in produced images (excellent).

Rank 4: extremely very faint residual image is observed (good).

Rank 3: very faint residual image is observed (fair).

Rank 2: faint residual image is observed but the images are still acceptable.

Rank 1: there is residual image which may cause a problem.

The results are shown in Table 12.

TABLE 12

| | Water vapor permeability ($g \cdot m^{-2} \cdot 24\ h^{-1}$) | Abrasion amount (μm) | Residual image (rank) |
|---|---|---|---|
| Ex. 31 | 31.2 | 0.9 | 5 |
| Ex. 32 | 47.3 | 0.8 | 5 |
| Comp. Ex. 9 | 98.6 | 0.8 | 2 |
| Comp. Ex. 10 | 32.0 | 7.2 | 5 |
| Comp. Ex. 11 | 100.1 | 4.1 | 2 |

As can be understood from Table 12, the images produced by the photoreceptors of Examples 31 and 32 and Comparative Example 10, which have a photosensitive layer having a water vapor permeability of about 30 $g \cdot m^{-2} \cdot 24\ h^{-1}$, have not residual image, but the images produced by the photoreceptors of Comparative Examples 9 and 11, which have a large water vapor permeability, have residual image.

In addition, the photoreceptors of Examples 31 and 32 have excellent abrasion resistance.

Example 33

The procedure for preparation of the photoreceptor in Example 31 was repeated except that the diameter of the aluminum substrate was changed to 90 mm; the thickness of the second CTL was changed to 5 μm; and the CGL coating liquid and the first and second CTL coating liquids were changed to the following:

| Formulation of the CGL coating liquid | |
|---|---|
| Trisazo pigment having the following formula (N) | 3 |

(N)

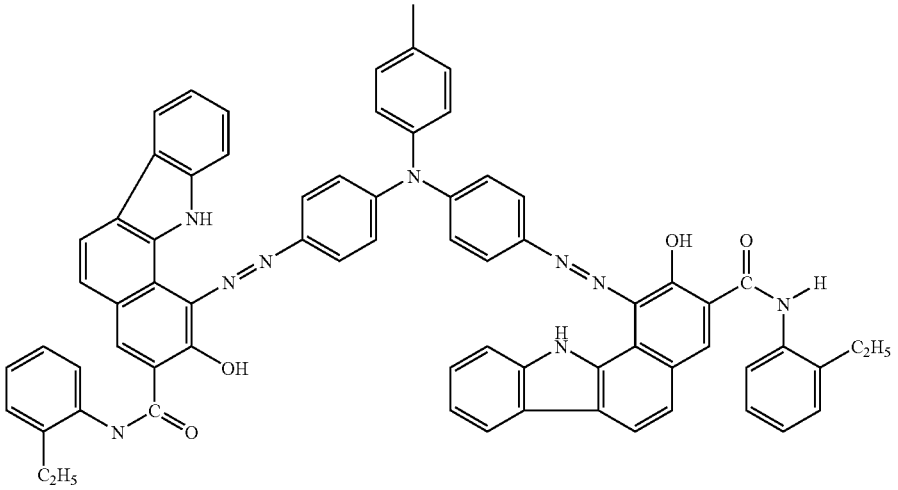

| | |
|---|---|
| Polyvinyl butyral (XYHL manufactured by Union Carbide Corp.) | 0.6 |
| Cyclohexanone | 200 |
| Methyl ethyl ketone | 80 |

| Formulation of the first CTL coating liquid | |
|---|---|
| Charge transport polymer having formula (K) (weight average molecular weight of 110,000) | 13.8 |
| CTM having formula (L) | 1.2 |
| Tetrahydrofuran | 100 |

-continued

| Formulation of the first CTL coating liquid | |
|---|---|
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having the following formula (P) (viscosity average molecular weight of 100,000) | 6.9 |

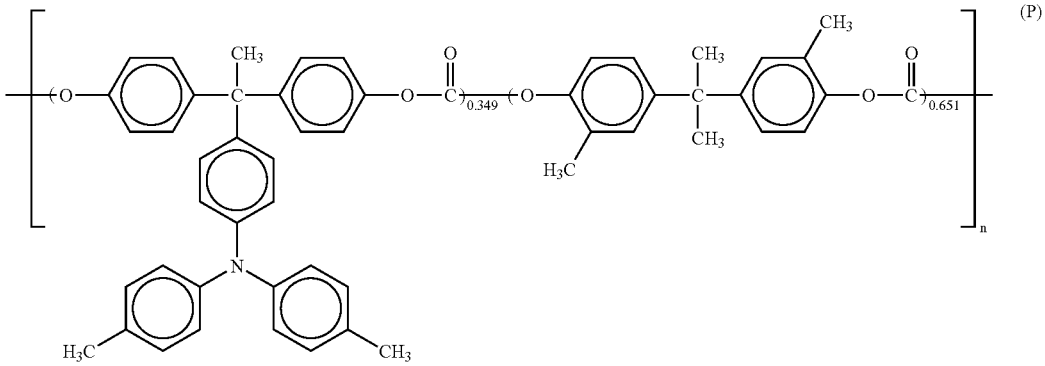

(P)

| | |
|---|---|
| CTM having formula (L) | 0.6 |
| α-alumina (SUMICORUNDUM AA-03 from Sumitomo Chemical Co., Ltd.) | 2.5 |
| Cyclohexanone | 80 |
| Tetrahydrofuran | 280 |

Thus a photoreceptor of Example 33 was prepared.

Example 34

The procedure for preparation of the photoreceptor in Example 33 was repeated except that the first and second CTL coating liquids were replaced with the following coating liquids, respectively.

| Formulation of the first CTL coating liquid | |
|---|---|
| Charge transport polymer having formula (K) (weight average molecular weight of 110,000) | 12.7 |
| CTM having formula (L) | 2.3 |
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having the following formula (K) (viscosity average molecular weight of 110,000) | 6.4 |
| CTM having formula (L) | 1.1 |
| α-alumina (SUMICORUNDUM AA-03 from Sumitomo Chemical Co., Ltd.) | 2.5 |
| Cyclohexanone | 80 |
| Tetrahydrofuran | 280 |

Thus a photoreceptor of Example 34 was prepared.

Comparative Example 12

The procedure for preparation of the photoreceptor in Example 33 was repeated except that the first and second CTL coating liquids were replaced with the following coating liquids, respectively.

| Formulation of the first CTL coating liquid | |
|---|---|
| Charge transport polymer having formula (K) (weight average molecular weight of 110,000) | 12.7 |
| CTM having formula (L) | 2.3 |
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having formula (K) (viscosity average molecular weight of 110,000) | 6.8 |
| CTM having formula (L) | 0.7 |
| α-alumina (SUMICORUNDUM AA-03 from Sumitomo Chemical Co., Ltd.) | 2.5 |
| Cyclohexanone | 80 |
| Tetrahydrofuran | 280 |

Thus a photoreceptor of Comparative Example 12 was prepared.

Comparative Example 13

The procedure for preparation of the photoreceptor in Example 33 was repeated except that the first and second CTL coating liquids were replaced with the following coating liquids, respectively.

| Formulation of the first CTL coating liquid | |
|---|---|
| Charge transport polymer having formula (K) (weight average molecular weight of 110,000) | 15 |
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having formula (K) (viscosity average molecular weight of 110,000) | 7.5 |
| α-alumina (SUMICORUNDUM AA-03 from Sumitomo Chemical Co., Ltd.) | 2.5 |
| Cyclohexanone | 80 |
| Tetrahydrofuran | 280 |

Thus a photoreceptor of Comparative Example 13 was prepared.

Comparative Example 14

The procedure for preparation of the photoreceptor in Example 33 was repeated except that the first and second CTL coating liquids were replaced with the following coating liquids, respectively.

| Formulation of the first CTL coating liquid | |
|---|---|
| Charge transport polymer having the following formula (Q) | 15 |

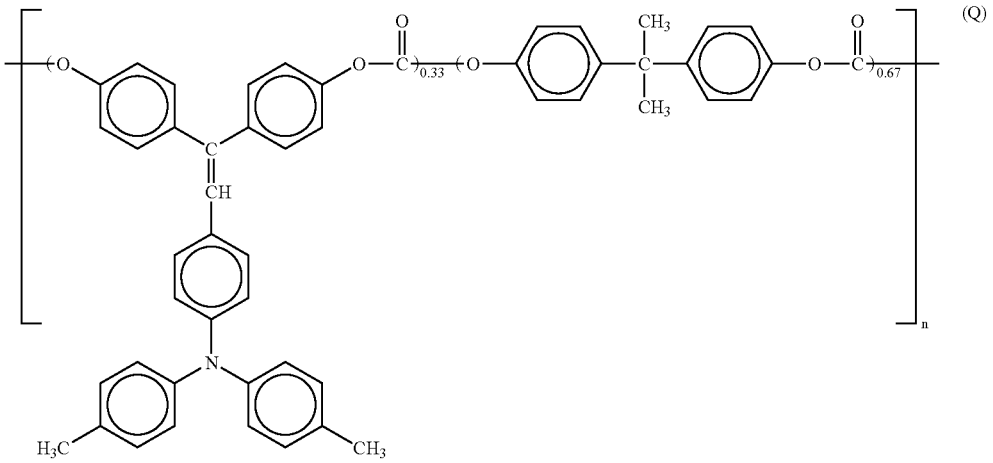

| | |
|---|---|
| (weight average molecular weight of 110,000) | |
| Tetrahydrofuran | 100 |
| 1% tetrahydrofuran solution of a silicone oil (silicone oil: KF50-100CS from Shin-Etsu Chemical Co., Ltd.) | 1 |

| Formulation of the second CTL coating liquid | |
|---|---|
| Charge transport polymer having formula (Q) (viscosity average molecular weight of 110,000) | 7.5 |
| α-alumina (SUMICORUNDUM AA-03 from Sumitomo Chemical Co., Ltd.) | 2.5 |
| Cyclohexanone | 80 |
| Tetrahydrofuran | 280 |

Thus a photoreceptor of Comparative Example 14 was prepared.

Each of the photoreceptors of Examples 33 and 34 and Comparative Examples 12 to 14 was set in a modified image forming apparatus of IMAGIO COLOR 4000 manufactured by Ricoh Co., Ltd., and a running test in which 200,000 color images were produced was performed. Each color image includes yellow, magenta and cyan color images and the percentage of image areas is 5%. The image forming conditions are as follows:

(1) Charger: a scorotron charger
(2) Voltage applied by the charger: the applied voltage was adjusted such that the initial potential of the photoreceptor was −800 V. The charging condition was not changed during the running test.
(3) Developing bias: −500 V
(4) Environmental condition: 40° C. 43% RH (a heater for preventing dew condensation was not provided)

At the beginning and end of the running test, the potential of the photoreceptor was measured to determine the potential variation (⊿VD). In addition, the resolution of the produced images was evaluated. After the running test, the abrasion amount of the photosensitive layer was checked. Further, the water vapor permeability of the photosensitive layer was measured.

The results are shown in Table 13.

TABLE 13

| | Water vapor permeability ($g \cdot m^{-2} \cdot 24\ h^{-1}$) | Abrasion amount checked after 200,000-sheet running test (μm) | ⊿VD (V) | Resolution (line/mm) |
|---|---|---|---|---|
| Ex. 33 | 45.6 | 4.9 | 3 | 7.1 |
| Ex. 34 | 47.6 | 4.7 | 3 | 7.1 |
| Comp. Ex. 12 | 56.3 | 4.6 | 15 | 5.0 |
| Comp. Ex. 13 | 141.2 | 4.8 | 73 | 4.5 |
| Comp. Ex. 14 | 203.4 | 4.9 | 199 | 4.0 |

As can be understood from Table 13, the photoreceptors of Examples 33 and 34 have good potential stability even under high temperature and high absolute humidity conditions.

In addition, since the photoreceptors of Examples 33 and 34 which have a photosensitive layer having a water vapor permeability not greater than 50 $g \cdot m^{-2} \cdot 24\ h^{-1}$, the photoreceptors can produce high resolution images even under high temperature and high absolute humidity conditions.

The cross section of each of the photoreceptors of Examples 1 to 34 was observed by a scanning electron microscope of 2,000 magnification power to measure the thickness TF (the thickness of the filler layer) of 20 points, which were sampled from the cross section at an interval of 5 μm, and the standard deviation of the thickness TF.

When the photoreceptors of Examples 1 to 34 were prepared such that the following relationship is satisfied:

$$1.2<(X/Y)<2.0$$

wherein X represents the difference between the weight of the photoreceptor before the filler-reinforced CTL (i.e., the second CTL) is not coated and the weight of the photoreceptor which has been allowed to settle for 1 hour after the filler-reinforced CTL is coated, and Y represents the difference between the weight of the photoreceptor before the filler-reinforced CTL is not coated and the weight of the photoreceptor which is heated after the CTL is coated, to dry the filler-reinforced CTL.

In addition, the filler-reinforced CTL and protective layer were prepared by a spray coating method. The conditions of the spray coating method are as follows:

(1) discharge amount: 12 ml/min
(2) discharge pressure: 2.0 kgf/cm$^2$
(3) revolution of photoreceptor: 360 rpm
(4) spray gun feeding speed: 24 mm/sec
(5) gap between gun and photoreceptor: 8 mm
(6) number of times of coating: from 2 to 10 times
(the thickness of a layer was controlled so as to be in a target range while changing the coating times)

After spray coating, the coated photoreceptors were allowed to settle for 1 hour under normal temperature and humidity. Then the weight of the photoreceptors was measured and then the photoreceptors were heated at 150° C. for 30 min.

The results are shown in Table 14.

TABLE 14

| | Average of TF (μm) | Standard deviation (μm) | X/Y |
|---|---|---|---|
| Ex. 1 | 1.5 | 0.15 | 1.7 |
| Ex. 2 | 1.5 | 0.15 | 1.7 |
| Ex. 3 | 1.5 | 0.15 | 1.7 |
| Ex. 4 | 1.5 | 0.21 | 1.8 |
| Ex. 5 | 1.5 | 0.21 | 1.7 |
| Ex. 6 | 2.0 | 0.21 | 1.8 |
| Ex. 7 | 1.5 | 0.20 | 1.7 |
| Ex. 8 | 1.5 | 0.20 | 1.7 |
| Ex. 9 | 1.5 | 0.17 | 1.6 |
| Ex. 10 | 1.5 | 0.20 | 1.7 |
| Ex. 11 | 1.5 | 0.22 | 1.7 |
| Ex. 12 | 1.5 | 0.19 | 1.7 |
| Ex. 13 | — | — | — |
| Ex. 14 | 1.5 | 0.21 | 1.7 |
| Ex. 15 | 1.5 | 0.29 | 1.6 |
| Ex. 16 | 1.5 | 0.29 | 1.7 |
| Ex. 17 | 1.5 | 0.21 | 1.7 |
| Ex. 18 | 1.5 | 0.21 | 1.7 |
| Ex. 19 | 1.5 | 0.21 | 1.7 |
| Ex. 20 | 1.5 | 0.18 | 1.7 |
| Ex. 21 | 1.5 | 0.21 | 1.6 |
| Ex. 22 | 1.5 | 0.16 | 1.8 |
| Ex. 23 | 2.5 | 0.38 | 1.8 |
| Ex. 24 | 2.5 | 0.38 | 1.8 |
| Ex. 25 | 2.5 | 0.35 | 1.8 |
| Ex. 26 | 2.5 | 0.38 | 1.8 |
| Ex. 27 | 4.5 | 0.60 | 1.8 |
| Ex. 28 | 4.5 | 0.60 | 1.8 |

TABLE 14-continued

| | Average of TF (μm) | Standard deviation (μm) | X/Y |
|---|---|---|---|
| Ex. 29 | 4.5 | 0.60 | 1.8 |
| Ex. 30 | 4.5 | 0.60 | 1.8 |
| Ex. 31 | 4.2 | 0.58 | 1.9 |
| Ex. 32 | 4.3 | 0.58 | 1.9 |
| Ex. 33 | 1.5 | 0.15 | 1.7 |
| Ex. 34 | 4.3 | 0.58 | 1.9 |

As can be understood from Table 14, the variation of the thickness of the filler-containing photosensitive layers is little. In addition, the interface between the filler-containing layer and the adjacent layer (the layer including no filler) cannot be observed except that the upper layer includes a filler. Further, the coating qualities of all the filler-containing layers were good.

Having now fully described the invention, it will be apparent to one of ordinary skill in the art that many changes and modifications can be made thereto without departing from the spirit and scope of the invention as set forth therein.

What is claimed as new and desired to be secured by letters patent of the United States is:

1. An image forming apparatus comprising:

a photoreceptor comprising, an electroconductive substrate, and a photosensitive layer located overlying the electroconductive substrate and comprising a charge generation material, a charge transport material and an inorganic filler such that the photosensitive layer is a single mixture photosensitive layer that comprises the charge generation material, the charge transport material and the inorganic filler and the inorganic filler has a gradient-like concentration with a highest concentration at a surface side of the photosensitive layer farthest from said electroconductive substrate and a lowest concentration at a bottom side of the photosensitive layer near the electroconductive substrate, wherein an outermost layer of the photoreceptor has a water vapor permeability not greater than 50 $g \cdot m^{-2} \cdot 24\ h^{-1}$, wherein the photosensitive layer is the outermost layer, and wherein the single mixture photosensitive layer has a thickness of from 5 μm to 50 μm;

a charger configured to charge the photoreceptor;

an image irradiator configured to irradiate the photoreceptor with imagewise light to form an electrostatic latent image on the photoreceptor;

an image developer configured to develop the electrostatic latent image with a developer including a toner to form a toner image on the photoreceptor; and an image transfer device configured to transfer the toner image onto a receiving material.

2. A process cartridge comprising:

a photoreceptor comprising, an electroconductive substrate, and a photosensitive layer located overlying the electroconductive substrate and comprising a charge generation material, a charge transport material and an inorganic filler such that the photosensitive layer is a single mixture photosensitive layer that comprises the charge generation material, the charge transport material and the inorganic filler and the inorganic filler has a gradient-like concentration with a highest concentration at a surface side of the photosensitive layer farthest from said electroconductive substrate and a lowest concentration at a bottom side of the photosensitive layer near the electroconductive substrate, wherein an outermost layer of the photoreceptor has a water vapor permeability not greater than 50 $g \cdot m^{-2} \cdot 24\ h^{-1}$, wherein the photosensitive layer is the outermost layer, and wherein the single mixture photosensitive layer has a thickness of from 5 μm to 50 μm;

at least one of a charger configured to charge the photoreceptor;

an image irradiator configured to irradiate the photoreceptor with imagewise light to form an electrostatic latent image on the photoreceptor;

an image developer configured to develop the electrostatic latent image with a developer including a toner to form a toner image on the photoreceptor;

an image transfer device configured to transfer the toner image onto a receiving material;

a cleaner configured to clean a surface of the photoreceptor; and a discharger configured to discharge a residual charge of the photoreceptor.

3. An image forming apparatus comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer such that the inorganic filler in the charge transport layer has a gradient-like concentration with a highest concentration at a surface side of the charge transport layer farthest from said electroconductive substrate and a lowest concentration at a bottom side of the charge transport layer near the electro conductive substrate, wherein an outermost layer of the photoreceptor has a water vapor permeability not greater than 50 $g \cdot m^{-2}$ $24\ h^{-1}$, and wherein the charge transport layer is the outermost layer;

a charger configured to charge the photoreceptor;

an image irradiator configured to irradiate the photoreceptor with imagewise light to form an electrostatic latent image on the photoreceptor;

an image developer configured to develop the electrostatic latent image with a developer including a toner to form a toner image on the photoreceptor; and an image transfer device configured to transfer the toner image onto a receiving material.

4. An image forming apparatus comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer such that the inorganic filler in the charge transport layer has a gradient-like concentration with a highest concentration at a surface side of the charge transport layer farthest from said electroconductive substrate and a lowest concentration at a bottom side of the charge transport layer near the electroconductive substrate, wherein an outermost layer of the photoreceptor has a water vapor permeability not greater than $50 g \cdot m^{-2} \cdot 24 h^{-1}$, wherein the charge transport layer is the outermost layer, and wherein the charge transport layer has a thickness of from 5 μm to 50 μm;

a charger configured to charge the photoreceptor;

an image irradiator configured to irradiate the photoreceptor with imagewise light to form an electrostatic latent image on the photoreceptor;

an image developer configured to develop the electrostatic latent image with a developer including a toner to form a toner image on the photoreceptor; and an image transfer device configured to transfer the toner image onto a receiving material.

5. An image forming apparatus comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer, wherein an outermost layer of the photoreceptor has a water vapor permeability not greater than $50 g \cdot m^{-2} \cdot 24 h^{-1}$, wherein the charge transport layer comprises a first charge transport layer not including the inorganic filler and a second charge transport layer including the inorganic filler and located on the first charge transport layer, and wherein the second charge transport layer is the outermost layer, and wherein at least one of the first charge transport layer and second charge transport layer includes at least two kinds of charge transport compounds, and wherein the difference in ionization potential between the at least two kinds of charge transport compounds is not greater than 0.15 eV;

a charger configured to charge the photoreceptor;

an image irradiator configured to irradiate the photoreceptor with imagewise light to form an electrostatic latent image on the photoreceptor;

an image developer configured to develop the electrostatic latent image with a developer including a toner to form a toner image on the photoreceptor; and an image transfer device configured to transfer the toner image onto a receiving material.

6. An image forming apparatus comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer, wherein an outermost layer of the photoreceptor has a water vapor permeability not greater than $50 g m^{-2} \cdot 24 h^{-1}$, wherein the charge transport layer comprises a first charge transport layer not including the inorganic filler and a second charge transport layer including the inorganic filler and located on the first charge transport layer, and wherein the second charge transport layer is the outermost layer, and wherein at least one of the first charge transport layer, the second charge transport layer and the charge transport layer has a charge mobility not less than $1.2 \times 10^{-5}$ $cm^2/V \cdot sec$ when measured at an electric field of $4 \times 10^5 V/cm$, and wherein the charge mobility has an electric field dependency β not greater than $1.6 \times 10^{-3}$, wherein the electric field dependency 13 is defined as follows:

$$\beta = log\ \mu / E^{1/2}$$

wherein log represents common logarithm; p represents the mobility of the at least one of the first charge transport layer, the second charge transport layer and the charge transport layer in units of $cm^2/V \cdot sec$; and B represents the electric field in units of V/cm;

a charger configured to charge the photoreceptor;

an image irradiator configured to irradiate the photoreceptor with imagewise light to form an electrostatic latent image on the photoreceptor;

an image developer configured to develop the electrostatic latent image with a developer including a toner to form a toner image on the photoreceptor; and an image transfer device configured to transfer the toner image onto a receiving material.

7. An image forming apparatus comprising:

a photoreceptor comprising, an electroconductive substrate, and a photosensitive layer located overlying the electroconductive substrate and comprising a charge generation material, a charge transport material and an inorganic filler such that the photosensitive layer is a mixture photosensitive layer, wherein an outermost layer of the photoreceptor has a water vapor permeability not greater than $50 g \cdot m^{-2} \cdot 24 h^{-1}$, wherein the mixture photosensitive layer comprises a first mixture photosensitive layer not including the inorganic filler, and a second mixture photosensitive layer including the inorganic filler and located on the first mixture photosensitive layer, wherein the second mixture photosensitive layer is the outermost layer, and wherein the first mixture photosensitive layer includes at least two charge generation compounds as the charge generation material and at least two charge transport compounds as the charge transport material, and wherein the second mixture photosensitive layer includes at least two charge generation compounds as the charge generation material and at least two charge transport compounds as the charge transport material, said at least two charge generation compounds and said at least two charge transport compounds included in the second mixture photosensitive layer are the same as or different from said at least two charge generation compounds and said at least two charge transport compounds included in the first mixture photosensitive layer, respectively;

a charger configured to charge the photoreceptor;

an image irradiator configured to irradiate the photoreceptor with imagewise light to form an electrostatic latent image on the photoreceptor;

an image developer configured to develop the electrostatic latent image with a developer including a toner to form a toner image on the photoreceptor; and an image transfer device configured to transfer the toner image onto a receiving material.

8. A process cartridge comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer such that the inorganic filler in the charge transport layer has a gradient-like concentration with a highest concentration at a surface side of the charge transport layer farthest from said electroconductive substrate and a lowest concentration at a bottom side of the charge transport layer near the electroconductive substrate, wherein an outermost layer of the photoreceptor has a water vapor permeability not greater than 50 $g \cdot m^{-2} \cdot 24\ h^{-1}$, and wherein the charge transport layer is the outermost layer;

at least one of a charger configured to charge the photoreceptor;

an image irradiator configured to irradiate the photoreceptor with imagewise light to form an electrostatic latent image on the photoreceptor:

an image developer configured to develop the electrostatic latent image with a developer including a toner to form a toner image on the photoreceptor;

an image transfer device configured to transfer the toner image onto a receiving material;

a cleaner configured to clean a surface of the photoreceptor; and a discharger configured to discharge a residual charge of the photoreceptor.

9. A process cartridge comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer such that the inorganic filler in the charge transport layer has a gradient-like concentration with a highest concentration at a surface side of the charge transport layer farthest from said electroconductive substrate and a lowest concentration at a bottom side of the charge transport layer near the electroconductive substrate, wherein an outermost layer of the photoreceptor has a water vapor permeability not greater than 50 $g \cdot m^{-2} \cdot 24\ h^{-1}$, wherein the charge transport layer is the outermost layer, and wherein the charge transport layer has a thickness of from 5 μm to 50 μm;

at least one of a charger configured to charge the photoreceptor;

an image irradiator configured to irradiate the photoreceptor with imagewise light to form an electrostatic latent image on the photoreceptor:

an image developer configured to develop the electrostatic latent image with a developer including a toner to form a toner image on the photoreceptor;

an image transfer device configured to transfer the toner image onto a receiving material;

a cleaner configured to clean a surface of the photoreceptor; and a discharger configured to discharge a residual charge of the photoreceptor.

10. A process cartridge comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer, wherein an outermost layer of the photoreceptor has a water vapor permeability not greater than 50 $g \cdot m^{-2} \cdot 24\ h^{-1}$, wherein the charge transport layer comprises a first charge transport layer not including the inorganic filler and a second charge transport layer including the inorganic filler and located on the first charge transport layer, and wherein the second charge transport layer is the outermost layer, and wherein at least one of the first charge transport layer and second charge transport layer includes at least two kinds of charge transport compounds, and wherein the difference in ionization potential between the at least two kinds of charge transport compounds is not greater than 0.15 eV;

at least one of a charger configured to charge the photoreceptor;

an image irradiator configured to irradiate the photoreceptor with imagewise light to form an electrostatic latent image on the photoreceptor:

an image developer configured to develop the electrostatic latent image with a developer including a toner to form a toner image on the photoreceptor;

an image transfer device configured to transfer the toner image onto a receiving material;

a cleaner configured to clean a surface of the photoreceptor; and a discharger configured to discharge a residual charge of the photoreceptor.

11. A process cartridge comprising:

a photoreceptor comprising, an electroconductive substrate, and a photosensitive layer located overlying the electroconductive substrate and comprising a charge generation material, a charge transport material and an inorganic filler such that the photosensitive layer is a functionally-separated photosensitive layer that comprises a charge generation layer including the charge generation material and formed overlying the electroconductive substrate, and a charge transport layer including the charge transport material and the inorganic filler and formed overlying the charge generation layer, wherein an outermost layer of the photoreceptor has a water vapor permeability not greater than 50 $g \cdot m^{-2}$ 24 $h^{-1}$, wherein the charge transport layer comprises a first charge transport layer not including the inorganic filler and a second charge transport layer including the inorganic filler and located on the first charge transport layer, and wherein the second charge transport layer is the outermost layer, and wherein at least one of the first charge transport layer, the second charge transport layer and the charge transport layer has a charge mobility not less than $1.2\times10^{-5}$ cm/V·sec when measured at an electric field of $4\times10^{5}$ V/cm, and wherein the charge mobility has an electric field dependency β not greater than $1.6\times10^{-3}$, wherein the electric field dependency β is defined as follows:

$$\beta = \log \mu / E^{1/2}$$

wherein log represents common logarithm; μ represents the mobility of the at least one of the first charge transport layer, the second charge transport layer and the charge transport layer in units of $cm^2/V \cdot sec$; and E represents the electric field in units of V/cm;

at least one of a charger configured to charge the photoreceptor;

an image irradiator configured to irradiate the photoreceptor with imagewise light to form an electrostatic latent image on the photoreceptor:

an image developer configured to develop the electrostatic latent image with a developer including a toner to form a toner image on the photoreceptor;

an image transfer device configured to transfer the toner image onto a receiving material;

a cleaner configured to clean a surface of the photoreceptor; and a discharger configured to discharge a residual charge of the photoreceptor.

12. A process cartridge comprising:

a photoreceptor comprising, an electroconductive substrate, and a photosensitive layer located overlying the electroconductive substrate and comprising a charge generation material, a charge transport material and an inorganic filler such that the photosensitive layer is a mixture photosensitive layer, wherein an outermost layer of the photoreceptor has a water vapor permeability not greater than 50 $g \cdot m^{-2} \cdot$ 24 $h^{-}$, wherein the mixture photosensitive layer comprises a first mixture photosensitive layer not including the inorganic filler, and a second mixture photosensitive layer including the inorganic filler and located on the first mixture photosensitive layer, wherein the second mixture photosensitive layer is the outermost layer, and wherein the first mixture photosensitive layer includes at least two charge generation compounds as the charge generation material and at least two charge transport compounds as the charge transport material, and wherein the second mixture photosensitive layer includes at least two charge generation compounds as the charge generation material and at least two charge transport compounds as the charge transport material, said at least two charge generation compounds and said at least two charge transport compounds included in the second mixture photosensitive layer are the same as or different from said at least two charge generation compounds and said at least two charge transport compounds included in the first mixture photosensitive layer, respectively;

at least one of a charger configured to charge the photoreceptor;

an image irradiator configured to irradiate the photoreceptor with imagewise light to form an electrostatic latent image on the photoreceptor:

an image developer configured to develop the electrostatic latent image with a developer including a toner to form a toner image on the photoreceptor;

an image transfer device configured to transfer the toner image onto a receiving material;

a cleaner configured to clean a surface of the photoreceptor; and a discharger configured to discharge a residual charge of the photoreceptor.

* * * * *